US006283192B1

(12) United States Patent
Toti

(10) Patent No.: US 6,283,192 B1
(45) Date of Patent: Sep. 4, 2001

(54) FLAT SPRING DRIVE SYSTEM AND WINDOW COVER

(76) Inventor: Andrew J. Toti, 311 W. River St., Modesto, CA (US) 95351

( * ) Notice: Subject to any disclaimer, the term of this patent is extended or adjusted under 35 U.S.C. 154(b) by 0 days.

(21) Appl. No.: 09/229,595

(22) Filed: Jan. 13, 1999

Related U.S. Application Data

(63) Continuation-in-part of application No. 08/989,142, filed on Dec. 11, 1997, now abandoned, which is a continuation-in-part of application No. 08/963,774, filed on Nov. 4, 1997, now abandoned.

(51) Int. Cl.[7] ..... E06B 3/322

(52) U.S. Cl. ..... 160/170 R; 160/84.04; 185/39; 185/45

(58) Field of Search ..... 160/170 R, 171 R, 160/168.1 R, 192, 172 R, 84.02, 84.06, 84.04, 191, 193; 267/155, 156; 185/37, 39, 45

(56) References Cited

U.S. PATENT DOCUMENTS

| | | | |
|---|---|---|---|
| 13,251 | 7/1855 | Bixler . | |
| 2,087,354 | 7/1937 | Muffly | 267/39 X |
| 2,266,160 | 12/1941 | Burns . | |
| 2,276,716 | 3/1942 | Cardona . | |
| 2,324,536 | 7/1943 | Pratt . | |
| 2,390,826 | 12/1945 | Cohn . | |
| 2,420,301 | 5/1947 | Cusumano . | |
| 2,824,608 | 2/1958 | Etten . | |
| 3,139,877 | 7/1964 | Graybill | 185/39 X |
| 3,151,704 | 10/1964 | Clarke | 185/37 |
| 3,194,343 | 7/1965 | Sindlinger | 185/39 X |
| 3,358,612 | 12/1967 | Bleuer | 267/156 X |
| 3,363,891 | 1/1968 | Foster | 267/180 X |
| 3,756,585 | 9/1973 | Mihalcheon | 267/156 |
| 4,399,959 | 8/1983 | Godsoe . | |
| 4,472,910 | 9/1984 | Iha | 160/189 |
| 4,635,755 | 1/1987 | Arechaga | 267/156 X |
| 4,664,531 | 5/1987 | King . | |
| 4,784,122 | 11/1988 | Graham . | |
| 5,054,162 | 10/1991 | Rogers . | |
| 5,105,867 | 4/1992 | Coslett | 160/192 X |
| 5,133,399 | 7/1992 | Hiller et al. | 160/171 R |
| 5,157,808 | 10/1992 | Sterner | 267/156 X |
| 5,170,830 | 12/1992 | Coslett | 160/192 X |
| 5,482,100 | 1/1996 | Kuhar . | |
| 5,531,257 | 7/1996 | Kuhar . | |
| 5,615,729 | 4/1997 | Matsumoto et al. . | |
| 5,813,447 | 9/1998 | Lysyj | 160/84.04 |

FOREIGN PATENT DOCUMENTS

| | | | |
|---|---|---|---|
| 0796994A2 | 9/1997 | (EP) . | |
| 883709 | 7/1943 | (FR) . | |
| 1068583 | 1/1984 | (SU) | 160/313 |

*Primary Examiner*—David M. Purol
(74) *Attorney, Agent, or Firm*—Philip A. Dalton

(57) ABSTRACT

A spring drive system for window covers is disclosed, which includes a so-called flat spring drive and the combination whose elements are selected from a group which includes (1) a band transmission which provides varying ratio power transfer as the cover is opened and closed; (2) a gear system selected from various gear sets which provide frictional holding force and fixed power transfer ratios; and (3) a gear transmission which provides fixed ratio power transfer as the cover is opened or closed. The combination permits the spring drive force at the cover to be tailored to the weight and/or compression characteristics of the window cover such as a horizontal slat or pleated or box blind as the cover is opened and closed.

44 Claims, 18 Drawing Sheets

46
47
44
48
49

36
34
37

29

24

41
33
44
32

31
33
34
32

26
28
29
27

21
28
24
22

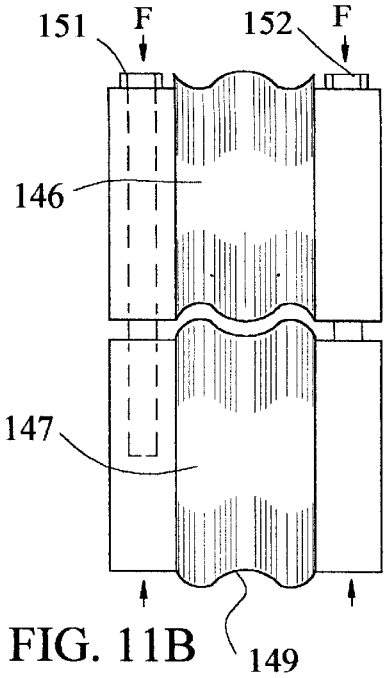
FIG. 11B
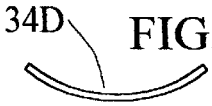
FIG. 11D
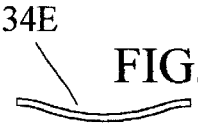
FIG. 11E
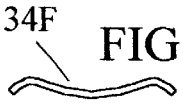
FIG. 11F
FIG. 42A
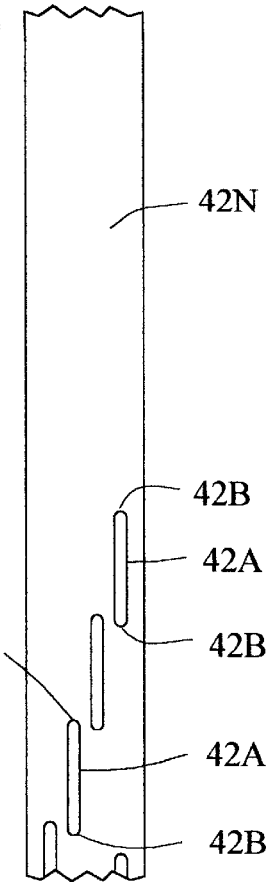
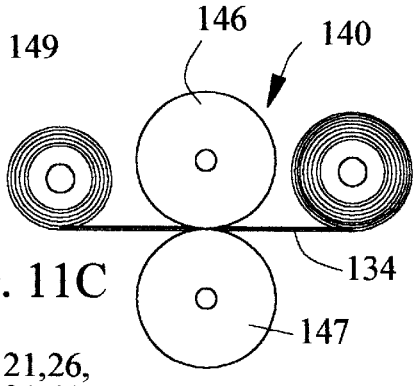
FIG. 11C
FIG. 13
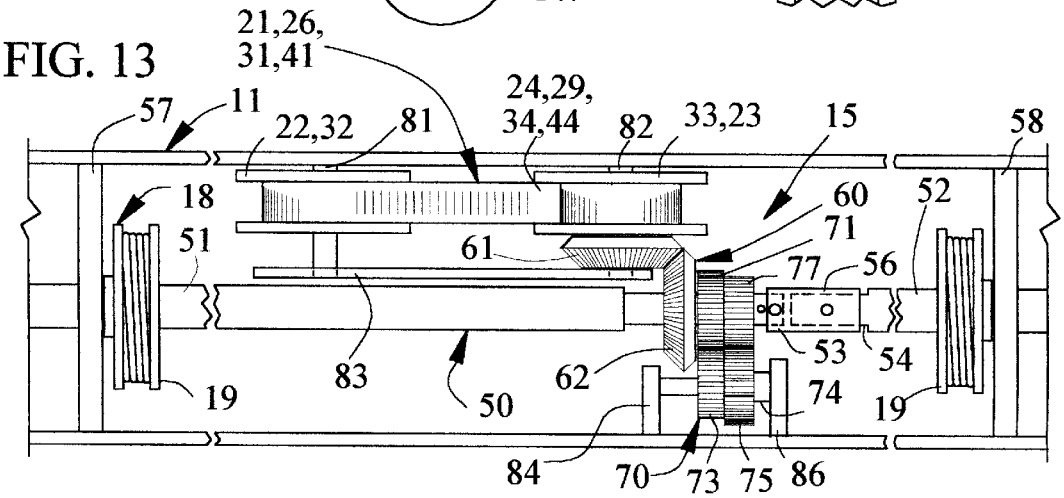

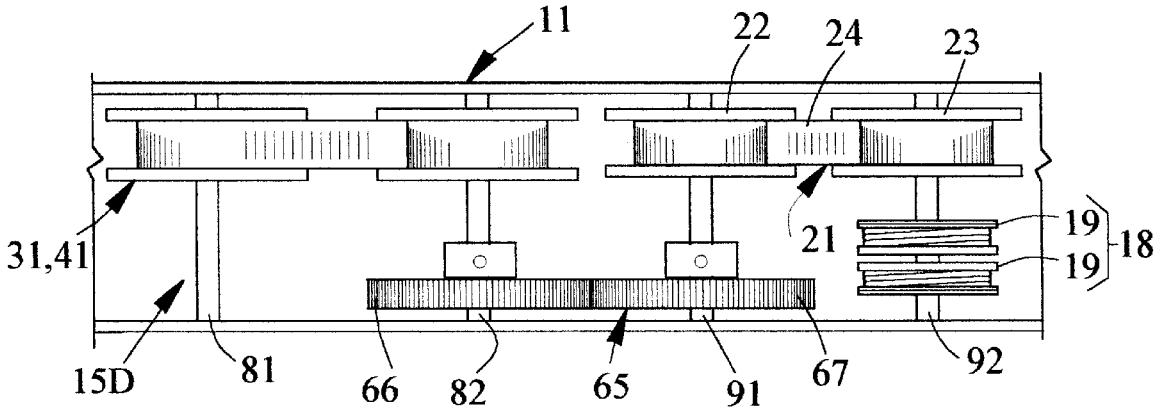
FIG. 17
FIG. 18
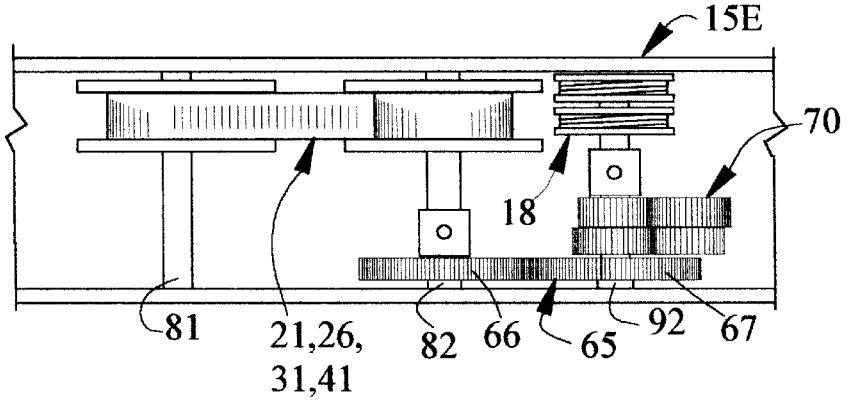
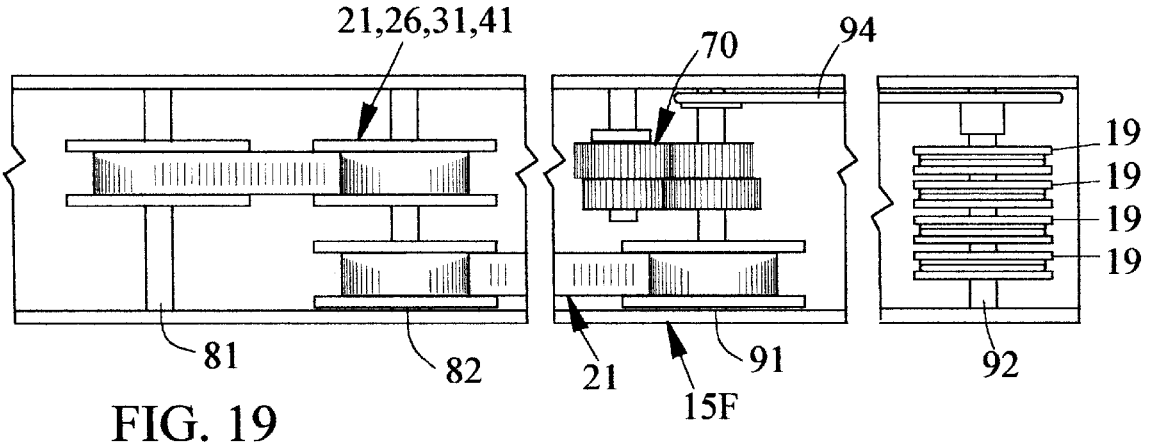
FIG. 19

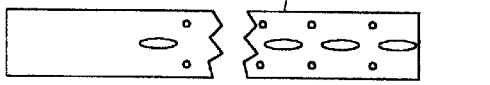
FIG. 22
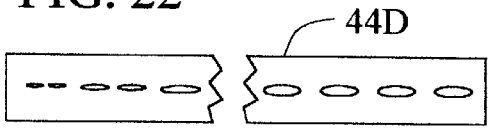
FIG. 23
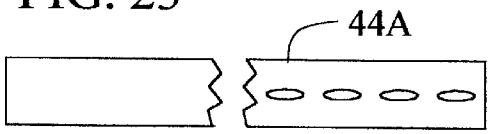
FIG. 20
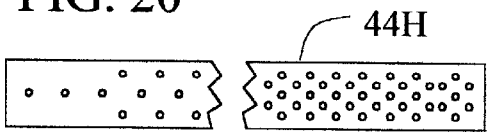
FIG. 27
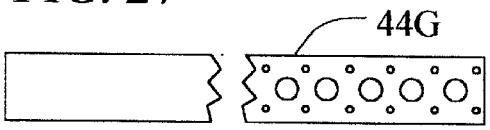
FIG. 26
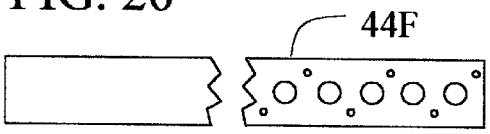
FIG. 25
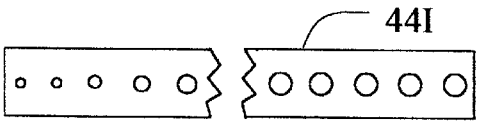
FIG. 28
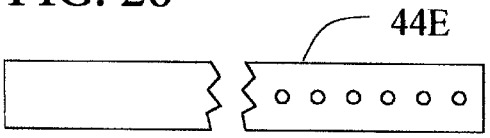
FIG. 24
FIG. 29 FIG. 30
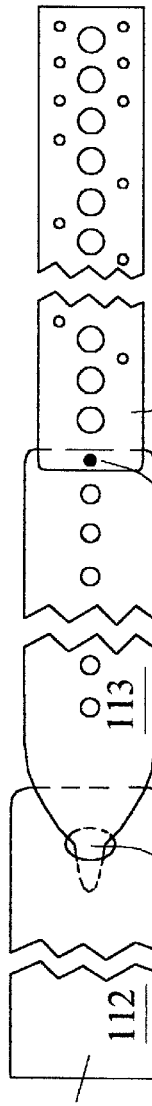
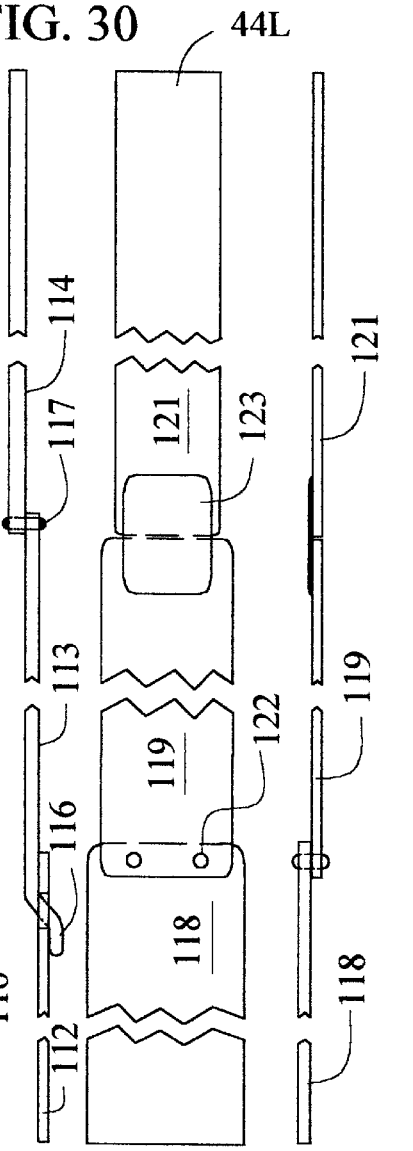
FIG. 31 FIG. 32
FIG. 21
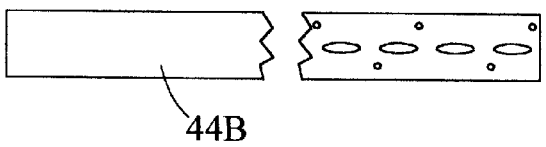

FLAT SPRING DRIVE SYSTEM AND WINDOW COVER

This is a continuation-in-part of U.S. patent application Ser. No. 08/989,142, titled FLAT SPRING DRIVE SYSTEM AND WINDOW COVER, filed Dec. 11, 1997, inventor Andrew J. Toti now abandoned; which is a continuation-in-part of U.S. patent application Ser. No. 08/963,774, titled FLAT SPRING DRIVE SYSTEM AND WINDOW COVER, filed Nov. 4, 1997, inventor Andrew J. Toti now abandoned.

BACKGROUND OF THE INVENTION

1. Field of the Invention

The present invention relates generally to flat spring drives or motors, which are useful in numerous applications and, in particular, relates to the application of such flat spring drives in window cover systems.

2. Definitions and Applicability

Typically, as used here, "cover" refers to expandable or extendible structures. These include slat structures such as so-called venetian or slat blinds and so-called mini-blinds. These structures also include pleated folding structures such as single and plural pleat structures and box, hollow and cellular structures. "Cover" also refers to fla g, sheet-type covers such as roller blinds. In this document, "cover" and "blind" are frequently used interchangeably. As applied to such covers, "operate" refers to the process of closing and opening the covers, typically (for horizontal covers) to lowering and raising the cover.

As used here, "horizontal" window cover refers to horizontally oriented covers such as horizontal slat blinds, horizontal folded pleat blinds and horizontal cellular blinds. The present invention is applicable generally to horizontal window cover systems and to flat window cover systems. It is understood that "window," as used for example in "window cover," includes windows, doorways, openings in general and even non-opening areas or regions to which covers are applied for decoration, display, etc.

As used here, the terms "operatively connected," "operatively coupled," "operatively connected or coupled" and the like include both direct connections of one component to another without intervening components and connections via intervening components including gears, transmissions, etc.

3. Current State of the Relevant Field

Typically a horizontal cover or blind is mounted above the window or space which is to be covered, and is operated using lift cords to extend the cover and lower it across the area, stopping at a selected position at which the blind partially or fully covers the area. For most horizontal slat blinds, the lift cords are attached to a bottom rail and the "rungs" or cross-members of a separate cord ladder are positioned beneath the slats of the blind. When the blind is fully lowered, each slat is supported by a rung of the blind's cord ladder and relatively little weight is supported by the lift cords. However, as the blind is raised, the slats are "collected" on the bottom rail, and the support of the slats is thus increasingly transferred from the cord ladder to the bottom rail and the weight supported by the rail and the lift cords increases.

Many pleated, cellular, box, etc., blinds are formed of resilient material having inherent spring-like characteristics. As the resilient pleated blind is raised toward the fully open position, the blind material is increasingly compressed, and requires increasingly greater force to overcome the compression force and move the blind and hold the blind in position. Effectively, then, both the slat blind and the pleated blind require increasingly greater force to open the blind and to maintain the blind open than is required to close the blind and maintain the blind closed.

The operating characteristics of conventional constant torque flat spring drives, especially long blinds, make it difficult to assist the opening and closing operation of horizontal and flat blinds. As applied to downward-closing embodiments of such blinds, spring drives usually are mounted at the top of the blind, and are operatively connected or coupled to the shaft about which the blind lift cords are wound. As described above, as the blind is lowered, the slat weight supported by the lift cords decreases and the compression of the pleats decreases. However, the torque force of the spring remains relatively constant, with the result that the spring torque may overcome the decreasing supported weight or the decreasing compression force, and raise the blind in fast, uncontrolled fashion. Also, it may be difficult to keep the blind at a selected position. Furthermore, if the blind is heavy, and requires a strong spring to maintain the blind open, the blind is particularly susceptible to instability and uncontrolled raising operation when partially or fully closed.

SUMMARY OF THE INVENTION

In one embodiment, the present invention is embodied in a spring drive which comprises a storage drum or spool, an output drum or spool, and a flat spring wound on the two drums or spools. In a preferred embodiment, the flat spring is adapted for providing a torque which varies along al least a section of the length of the spring. In a specific embodiment, at least one section of the spring has a cove of selected curvature which varies along the length of the spring for providing torque which varies proportional to the cove as the spring winds and unwinds. In another specific embodiment, at least one section of the spring has holes of selected size and location along the spring axis for providing torque which varies indirectly proportional to the transverse size of the holes and the resulting effective width of the spring as the spring winds and unwinds.

In another embodiment, the present invention is embodied in a plural spring drive system comprising an output drum; and a plurality of storage drums, each having a flat spring wound thereon. The plurality of flat springs extend to and are wound together in overlapping fashion on the output drum, such that the system torque at the output drum is a multiple of the torques associated with the individual flat springs. Various alternative arrangements can be used, for example, the storage drums can be arranged in approximately a straight line; the output drum and the storage drums can be arranged in approximately a straight line; the storage drums can be arranged in a cluster; and the output drum and the storage drums can be arranged in a cluster. In a preferred embodiment, at least one of the flat springs is adapted for imparting a torque component to the system torque which varies along the length of the said one spring. In one specific embodiment, the said one spring has a cove or transverse curvature which selectively varies along the length of the said spring for providing torque which varies proportional to the transverse curvature of the said spring at a position closely adjacent the output drum as the said spring winds and unwinds. In another specific embodiment, the said one spring has holes along its length for providing torque which varies proportional to the transverse size of the holes and the resulting effective width of the said spring when one or more holes is positioned closely adjacent the output drum as the spring winds and unwinds.

In another embodiment, the spring drive further comprises a magnetic brake comprising one or more magnetizable regions or magnets at selected positions along the flat spring, or at least one of the flat springs; and a magnet brake member mounted adjacent the flat spring, so the brake member stops the flat spring at the selected positions.

In yet another embodiment, the spring drive further comprises a detent brake comprising one or more holes at selected positions along the flat spring, or at least one of the flat springs; and a detent brake member biased against the flat spring for engaging the holes and stopping the flat spring at the selected positions.

Other embodiments of spring drives in accordance with the present invention include constant cove section(s); and/or sections selected from varying cove(s), including reverse curvature cove(s); and/or perforated section(s).

Still additional specific embodiments of the present invention include individual spring drives comprising plural springs, and spring drive systems comprising plural spring drive units, including individual spring drive units which comprise single or plural springs.

The present invention is also embodied in window cover systems which include one or more spring drives of the type described herein.

Additionally, the present invention is embodied in spring drives and spring drive cover systems which include drive and/or transfer systems selected from mechanisms which include gear and band systems and transmissions, bevel gear sets, and varied ratio cord pulley systems in accordance with the present invention; braking devices selected from mechanisms including detent, magnetic and recoiler brakes, in accordance with the present invention; operating mechanisms selected from cranks and cord pulley systems in accordance with the present invention; and battery-assisted systems.

In specific applications embodying the present invention, one or more of the spring drives are incorporated in window cover systems for providing torque or force tailored to the operating characteristics of the cover. In another application, the spring drive (or drives) is used in combination with one or more band shift transmissions for varying the drive force of the spring; one or more gear transmissions for providing a fixed gear ratio to fixedly alter the drive force of the spring; and one or more connecting gear sets and mechanisms. In addition to controlling the applied force of the spring, the transmissions alter the length of the cover and provide inertia and friction for maintaining the blind at selected positions between and including open and closed positions.

Other aspects and embodiments of the present invention are described in the specification, drawings and claims.

BRIEF DESCRIPTION OF THE DRAWINGS

The above and other aspects of the invention are described below in conjunction with the following drawings.

FIGS. 11A, 11B and 11C are, respectively, a perspective view, an end elevation view sans spring, and a schematicized side elevation view of a roll forming assembly for forming springs of constant or varied cove.

FIGS. 11D, 11E and 11F are transverse cross-section views of springs having, respectively, constant cove, relatively shallow reverse edge curvature, and relatively deep reverse edge curvature.

FIGS. 13–19 are top plan views of spring drive units embodying the present invention.

FIGS. 20–28 and 42 depict additional embodiments of the perforated spring of FIG. 12.

FIGS. 29 and 30 are top and side views, respectively, of a perforated spring comprising separate sections joining by various joining means or members.

FIGS. 31 and 32 are top and side views, respectively, of a non-perforated sectioned spring.

FIG. 42 depicts another alternative perforated spring, one which comprises two laterally spaced parallel rows of longitudinally spaced, longitudinally elongated slots 42, for providing uniform torque characteristics.

FIG. 42A depicts yet another perforated spring, one comprising longitudinally-overlapping elongated slots having round, semi-circular ends 42B, for providing uniform torque characteristics.

DETAILED DESCRIPTION OF THE PREFERRED EMBODIMENT(S)

1. Examples of Applicable Blinds

Figure 1:
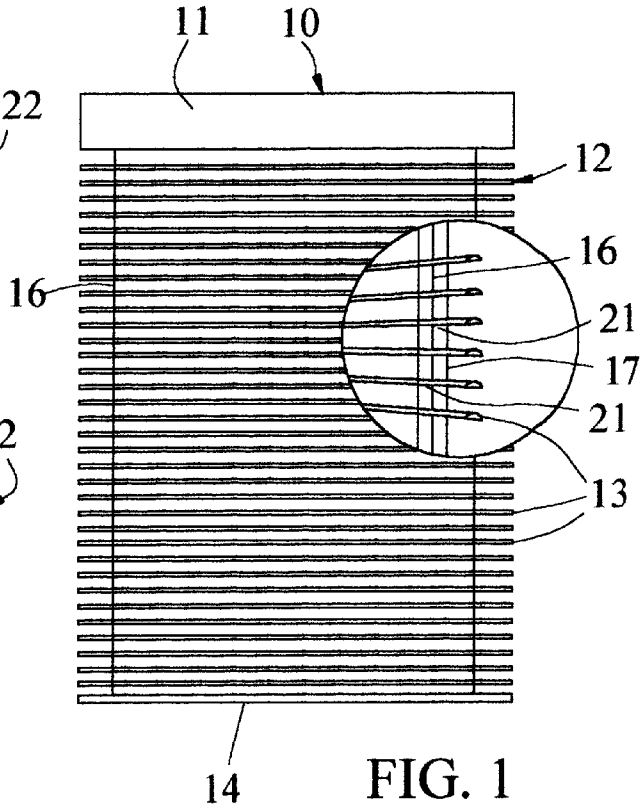
FIG. 1 is a front elevation view of a horizontal slat blind window cover system, showing the cover in a lowered (closed) condition.
Figure 2:
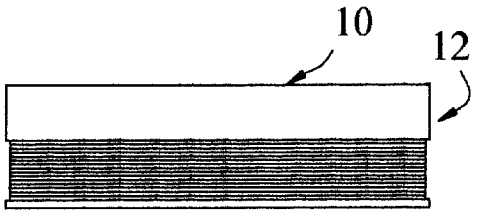
FIG. 2 is a front elevation view of the window cover system of FIG. 1, showing the cover in a near fully-raised (near open) condition.

FIGS. 1 and 2 depict a conventional horizontal slat (venetian) window cover system 10 in closed (fully lowered) and nearly fully open positions, respectively. The cover system 10 comprises an elongated top housing or support 11 within which a spring drive unit such as unit 15, FIG. 13, is mounted. The associated blind 12 comprises horizontal slats 13 and a bottom rail 14 which can be the same as the slats but, preferably, is weighted to enhance the stability of the blind 12.

Figure 4:
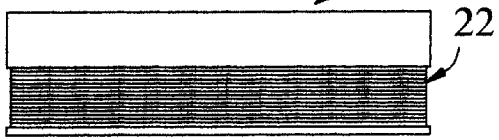
FIG. 4 is a front elevation view of the window cover system of FIG. 3, showing the cover in a near fully-raised (near open) condition.
Figure 3:
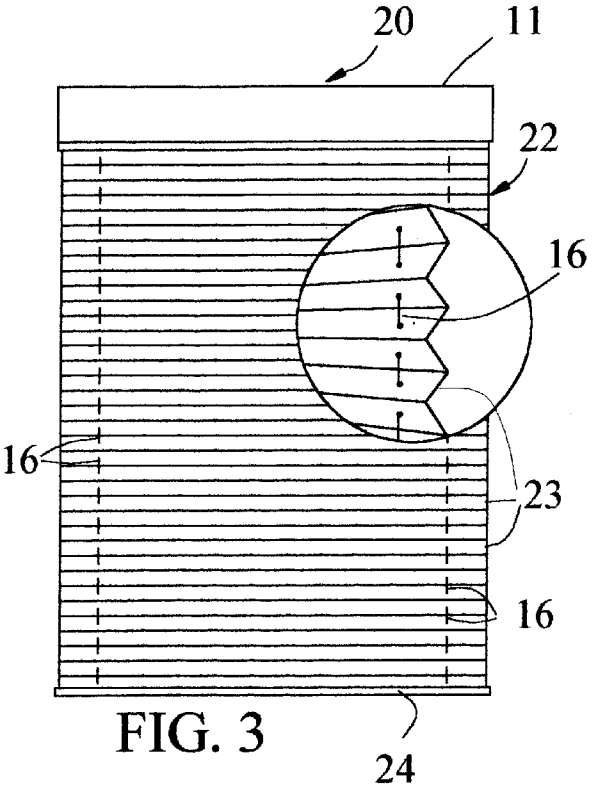
FIG. 3 is a front elevation view of a horizontal pleated blind window cover system, showing the cover in a lowered (closed) condition.

FIGS. 3 and 4 depict a conventional horizontal pleated blind cover system 20 in closed and nearly fully open positions, respectively. The blind cover system 20 comprises housing 11 within which the spring drive unit 15 is mounted. The associated blind 22 typically comprises light weight fabric or other material which is resilient and maintains the shape of horizontal pleats 23. The blind also includes a bottom rail 24 which is sufficiently heavy, or weighted, to provide stability to the blind 22.

Regarding slat blind 10, FIGS. 1 and 2, and as is typical of such blinds, spaced cord ladders 17 are suspended from the support 11 and the rungs 21 of the ladders are routed along and/or attached the underside of the individual slats 13 so that when the ladders are fully extended (lowered) and the blind 12 is thus fully lowered, as depicted in FIG. 1, the weight of each slat is supported by the ladders, with little weight on the lift cords. In contrast, as the blind 12 is raised from the lowermost position, for example to the partially raised/lowered position depicted in FIG. 2, the slats are sequentially "collected" on the bottom rail 14, starting with the bottommost slats, so that an increasing weight is supported on the bottom rail and by the lift cords 16. Thus, and perhaps counter-intuitively, the weight supported by the lift cords is a maximum when the blind is fully open (raised), and a minimum when the blind is fully closed (lowered).

As discussed previously, the force requirements of horizontal pleated blinds such as blind 20, FIGS. 3 and 4 are somewhat similar to the slat blind 10 in that the compression of the pleats 23 increasingly opposes movement of the blind as it is raised. thus increasing the force required to open the blind and to maintain the blind in position. Conversely, the decreasing compression of the material as the blind is lowered toward the closed position decreases the force requirement.

The following exemplary spring drives and transmissions are used in any combination to provide easy-to-use, stable window covering operation. Section 2 below contains a brief discussion of the spring drives shown in FIGS. 5–12 and two transmissions. In section 3, the various combinations depicted in FIGS. 13–19 are discussed.

2. Spring Drives and Transmissions a. Band Shift Transmission

Figures 5, 6, 7, 8, 9, 10, 11, 12:
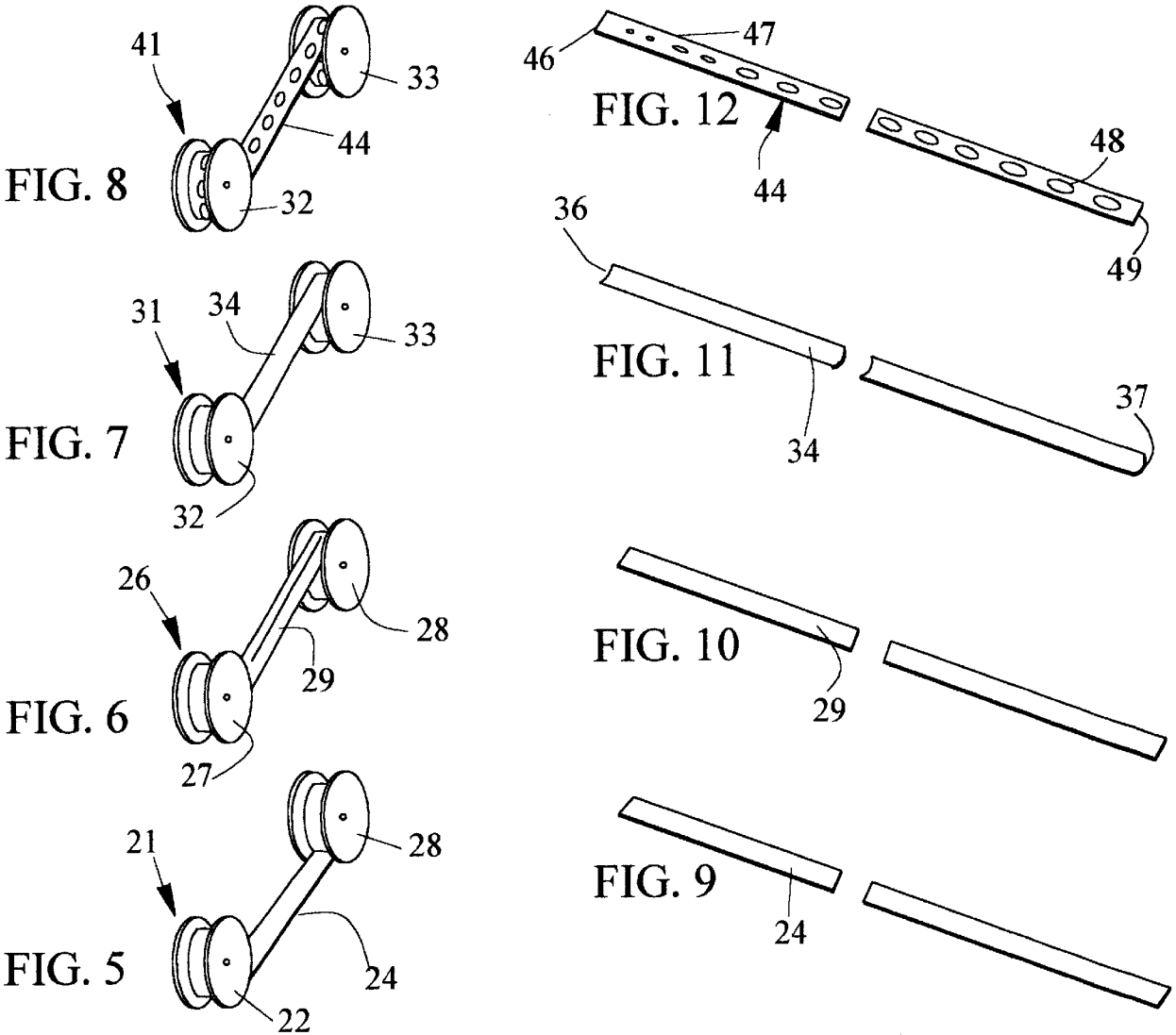
FIG. 5 is a perspective of a band shift transmission in accordance with the present invention.
FIG. 6 is a perspective of a flat spring drive.
FIG. 7 is a perspective of a varied torque, flat spring drive having varied cove in accordance with the present invention.
FIG. 8 is a perspective of a varied torque, flat spring drive having holes in accordance with the present invention.
FIG. 9 is a perspective view of the band of FIG. 5.
FIG. 10 is a perspective view of the flat spring of FIG. 6.
FIG. 11 is a perspective view of the varied cove spring of FIG. 7.
FIG. 12 is a perspective view of the perforated spring of FIG. 8.

FIGS. 5 and 9 depict a band shift transmission or gear unit 21 which comprises a pair of drums or spools 22, 23, about which is wound a cord or band 24. Preferably the band is an elongated strip of thin cloth or thin steel having a flat rectangular cross-section. However, other suitable materials can be used, and other cross-section shapes can be used which provide controlled variation in the radii on the drums. For example, a circular or oval cross-section cord-type band can be used. As used here, the term "band" includes, in accordance with the preferred embodiment, a thin, flat rectangular shape, but also includes other suitable cross-section shapes as well.

The band shift transmission (also, simply "band transmission" or "shift transmission") provides a varying drive ratio which is used to increase or diminish the torque or force of the spring drive unit. The band shift transmission applies the varying drive ratio between the spring drive and the lift cord pulleys. The ratio of the band transmission is determined by the radius of the band stored on each drum. The radii vary as the band winds and unwinds, varying the associated gear ratio. Thus, increasing (decreasing) the thickness of the band, increases the rate at which the radii increase and decrease, and increases the gear ratio provided by the transmission. By way of example but not limitation, a band thickness of 0.014 inches has given satisfactory results.

The manner of mounting the band can be used to decrease or increase the ratio of the speed of the spring output drum relative to that of the lift cord pulleys as the blind is lowered. Preferably, the band 24 is mounted so the band radius on output drum 23 increases relative to the band radius on storage drum 22 as the blind is lowered, and decreases as the blind is raised, thus offsetting or decreasing the power with which the spring would otherwise oppose the blind, enhancing or increasing somewhat the lifting power of the spring during raising of the blind, increasing the distance traveled by the blind relative to the spring drive, and increasing the maximum operational length of the blind (the distance between the fully raised and fully lowered positions). Of course, the band shift transmission 21 can be arranged so the output drum radius decreases relative to the storage drum radius as the blind is lowered and increases relative to the storage drum radius as the blind is raised, thereby increasing the force during lowering of the blind, decreasing the force during raising of the blind and decreasing blind length.

b. Flat Spring Drives

Referring now to FIGS. 6 and 10, conventional "flat" spring drive unit 26 comprises a pair of drums or spools 27, 28, about which is wound a flat metal spring 29 that provides nearly constant torque regardless of its wound position on the drums.

Referring next to FIGS. 7 and 11, varied torque flat spring drive unit 31 comprises a flat metal spring 34 of varying cove, which is wound around drums or spools 32, 33. One drum, such as left drum 32 is a storage drum; the other drum 33 is the output drum. The torque or force of the spring 34 is directly proportional to the degree of cove or transverse curvature of the spring. Thus, for example, and in one preferred embodiment, the cove varies from a relatively small degree of transverse curvature (nearly flat, small cove) at end 36 to a relatively large degree of curvature (large cove) at the opposite end 37. Examples, representative, but by no means limiting, are $\frac{3}{8}$ W×$\frac{1}{16}$ R of curvature or "coveness" at the shallow coved end and $\frac{3}{8}$ W×$\frac{3}{8}$ R of coveness at the highly coved end (W and R are, respectively, width and radius in inches).

Figure 11A:
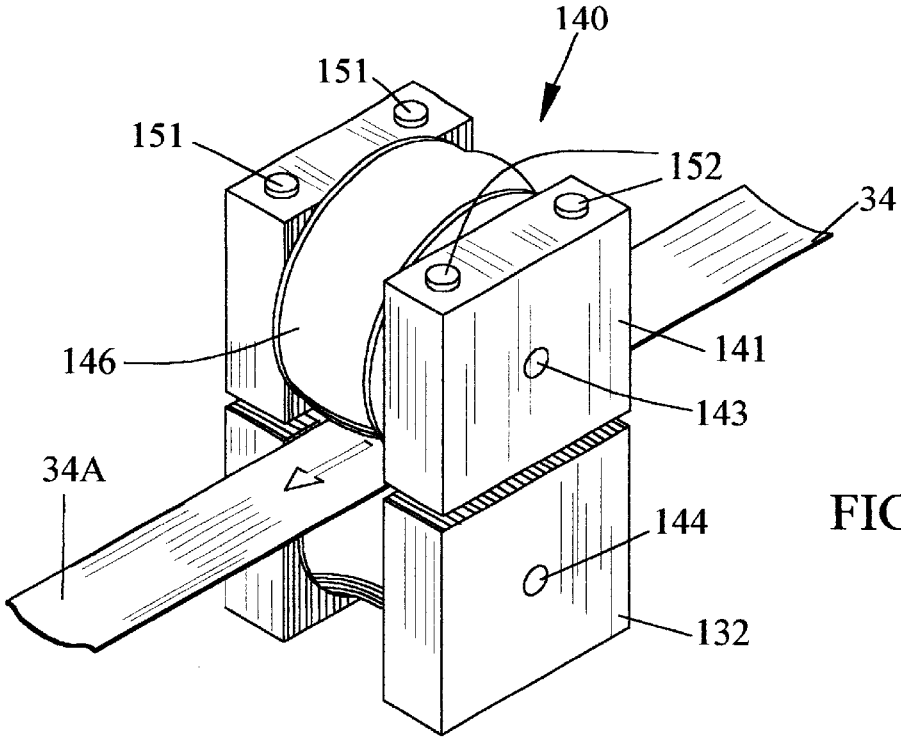

FIGS. 11A, 11B and 11C are, respectively, a perspective view, an end elevation view sans spring, and a schematicized side elevation view of a roll form assembly 140 for forming springs of constant or varied cove. As illustrated, the forming assembly 140 is used to form a non-coved or coved spring 34 into a spring 34A having a cove configuration having at least a section thereof which varies longitudinally, along the length of the spring, and/or transversely, along the width of the spring. In a preferred embodiment, at least a longitudinal section of the spring 34A comprises a reverse curvature or cove, FIGS. 11E and 11F, in which the configuration of one or both edges is different from the cove of the intermediate transverse region of the spring. That is, one or both edges (1) has less curvature than the intermediate region, (2) is flat (no curvature), or (3) has a curvature opposite to that of the intermediate region, All three cases provide decreased torque, torque of smaller magnitude than would be available from a spring having the curvature of the intermediate region edge-to-edge. Specifically, a spring of configuration (1) or (2) provides lesser torque than is provided by a spring having the intermediate curvature edge-to-edge and, opposite curvature, configuration (3), actually provides a net spring torque which is less than the magnitude of the torque provided by the intermediate region.

Illustratively, the forming assembly 140 comprises upper and lower support block assemblies 141 and 142 which include shafts 143 and 144 mounting upper and lower rolls or wheels 146 and 147. The rolls 146 and 147 have oppositely configured, generally flattened "w" shaped, convex and concave surfaces 148 and 149, best depicted in FIG. 11B. The illustrated assemblies 141 and 142 are mounted on shafts 151 and 152 for movement relative to one another. Preferably, a computer-controlled drive system (not shown) moves the upper (and/or the lower) assembly and roll bidirectionally vertically relative to the other assembly to increase and decrease the force applied by the spring, thereby to control the configuration of the spring cove as the spring is passed through the forming assembly 140, as shown in FIG. 11A. The drive may be, for example, a screw drive which is connected to and moves the assemblies 141 and 142 and rolls in precisely controlled increments relative to one another. Many other drive arrangements are possible. For example, the shafts 151 and 152 may be screw drives which are mounted within threaded bores in the assemblies 141 and 142 and by rotation move the assemblies 141 and 142 relative to one another.

As alluded to above, a given spring 34 can have a constant cove or flat (non-coved) configuration along its length, can have a cove that varies continuously along its length, or can have sections selected from flat (non-coved), constant cove, and varied cove. The constant and varied cove sections can be selected from numerous configurations, including a single cove configuration 34D, FIG. 11D; and a double or reverse cove configuration 34E and 34F, FIGS. 11E and 11F. This allows the torque of the spring and of the resulting spring drive to be tailored to the supported weight of the associated blind at different positions between and including the fully closed and fully opened positions. For example, the coved spring configuration 34D may be used to provide a high (maximum value) torque for a given cove curvature for supporting a fully raised (open) blind; whereas configuration 34E, which has a similar central curvature but relatively shallow reverse-curved edge sections provides lower (intermediate value) torque than cove 34D, corresponding to a blind position intermediate the fully raised and lowered positions; and configuration 34F comprising similar central curvature but relatively deeply-curved edge sections effects even lower (minimum value) net torque, corresponding to the decreased supported weight at or near the lowered (closed) window cover position. Please note, typically the curvature in the drawings is exaggerated, to aid understanding.

Referring next to FIGS. 8 and 12, varied torque flat spring drive 41 comprises a perforated spring 44 which is wound around wheels or spools 32, 33. Again drum 32 is the storage drum and drum 33 is the output drum. The torque or force of the spring 44 is directly proportional to the amount of spring material at a given point or region. The number, location, size and/or shape of the perforations or holes can be tailored to provide many different force curves, including constantly varying (decreasing or increasing), intermittent or discrete variations such as sawtooth or spiked force patterns, cyclical or sinusoidal patterns, etc. Thus, for example, and in one preferred embodiment, a line of spaced holes is formed generally along the center line of the spring 44, increasing in diameter from holes 47 of relatively small diameter near end 46 to relatively large diameter holes 48 near opposite end 49. As a result, the torque or force effected by the spring 44 decreases from a relatively large magnitude at end 46 to a relatively small magnitude at end 49. The hole size and spacing is selected to provide a drive force which varies in direct proportion to the lift cord-supported weight or the compression of the blind 12, 22. That is, the force decreases as the spring is unwound toward the blind-fully-down position shown in FIGS. 1 and 3 and, conversely, increases as the spring is wound or rewound as shown in FIGS. 2 and 4 toward the blind-fully-up position. (This is in direct contrast to the operation of coil springs, whose spring force varies inversely to the variation of the cord-supported weight of the blind, and constant torque flat springs, whose force is approximately constant as the spring unwinds and winds.)

In general, the spring drive units 31 and 41 are configured so that contrary to the usual coil spring or flat spring operating characteristics, (1) as the spring unwinds or winds as the blind is lowered or raised, the spring torque or force decreases or increases in direct proportion to, and remains closely matched to, the supported weight or compressive force of the blind; (2) from a fully or partially open position, the blind is easily lowered to any selected position by a slight downward pull on the blind; (3) from a fully or partially closed position, a slight upward push by hand is sufficient to raise the blind to any selected position; and (4) the stability of the blind is enhanced in that the tendency of the blind to move from the selected positions is suppressed.

c. Transmission 70

The spring drive unit such as 26, 31, 41 is operatively connected by bevel gear set 60 to shaft 50, FIG. 13, and transmission 70. The bevel gear sets permit compact arrangements for transferring power/rotation when interconnected components such as the pulley(s) and the spring drive(s) are mounted on shafts which are non-parallel. As described in detail below, the shaft 50 is connected to transmission idler gear 71, so that the right side, output drum rotates with the idler gear 71 of the transmission 70 and vice versa. The transmission 70 is designed to either offset or supplement the operating characteristics of the spring drive unit, as desired.

In one illustrated exemplary embodiment, the transmission 70 comprises an array of gears 71, 73, 75 and 77, in which idler gears 71 and 73 are intermeshed and idler gear 75 and power gear 77 are intermeshed. Idler gear 71 and an integral sleeve or collar are mounted on and rotate with shaft section 53 and vice versa. Gears 73 and 75 are joined, forming a gear set. This gear set and an integral collar are mounted on and fastened to shaft 74, which is mounted to and between supports 84 and 86. Power gear 77 and an integral collar are mounted on and fastened to shaft section 53. Power gear 77 meshes with gear 75 of the two-gear set, the other gear 73 of which meshes with idler gear 71.

As mentioned, shaft end section 53 is part of the interconnected shafts (or shaft sections). Thus, at one end of the transmission gear train, power gear 77 is joined to and rotates at the same rate as the shaft 53 and lift cord pulleys 19-19. At the opposite end of the transmission gear train, idler gear 71 and interconnected bevel gear 62 rotate freely about the shaft 50 and are connected via bevel gear 61 to the right side drum of the spring drive. As the result of this arrangement, the pulleys 19-19 and the lift cords 16, 17 rotate at one rate, the same rate as gear 77 and shaft 50, and the spring rotates at another rate, the same rate at which the right side output drum, the idler gear 71 and the bevel gears 60.

Preferably the transmission gear ratio is selected so that the idler gear 71 and spring drive 26, 31, 41 rotate at a slower rate than the power gear 77 and the lift cords 16, 17. For example in one application, the fixed drive ratio of the transmission 70 is 1:3 to 1:8 so that gear 77 and pulleys 19-19 rotate 3–8 revolutions for each revolution of the right side output drum. Obviously, however, in applications where such is advantageous, the drive ratio of the transmission can be selected to rotate the spring drive faster than the pulleys.

The above transmission gear ratios and the different rotation rates diminish proportionately the torque exerted by the spring 29, 34, 44 as it is wound in one direction and the blind is lowered. This permits the use of a powerful spring to hold a large, heavy blind in position at the uppermost position, where the supported weight and the pleat compression is the greatest, and diminishes the force otherwise exerted by the spring at the lowermost, closed condition where the supported weight and the pleat compression is a minimum. As a result, a powerful spring does not overpower the weight of the blind and does not uncontrollably raise the blind. The transmission gear ratio also increases the length of travel available to the blind for a given spring, permitting a longer blind for a given spring or a given spring travel. Furthermore, the transmission 70 has inherent friction which acts as a brake and retains the blind at selected positions between and including fully open and fully closed. The combination of the preferably varying torque/force provided by the flat spring drive directly proportional to the supported weight/compression of the blind; the transmission gear ratio; and the gear friction allows the spring drive unit to hold the blind 10, 20 in position at even the "heaviest" (uppermost) blind positions, and allows the blind to be pulled downward to any selected position by gently pulling the blind to that position and, conversely, to be pushed upward to any selected position by gently pushing upward to that position. Little force is required to move the blind up and down, the blind stops accurately at any selected position between and including the fully open and fully closed positions, and the blind remains at the selected positions.

3. Flat Spring Drive Window Covers a. Spring Drive and Transmission (FIG. 13)

Referring further to FIG. 13, there is shown spring drive unit 15 which embodies the present invention. The spring drive unit is mounted inside housing 11 and includes shaft 50 comprising left shaft or section 51 and right shaft or section 52. Adjacent ends 53, 54 of the shafts 51, 52 have reduced radius or size and are joined by collar 56. The separate shaft sections facilitate the removal of shaft 50 and the installation and replacement of the drive components mounted on the shaft. The shaft 50 is rotatably journaled within transverse walls or support members 57, 58. Two lift cord pulleys 19 and 19 are mounted on the shaft 50 adjacent the transverse walls 57 and 58. The spaced lift cords 16 and 17 are attached to bottom rail 14 (FIG. 1), 24 (FIG. 3) and are wound about the pulleys 19-19 for raising and lowering the bottom rail and thus the blind 10 or 20.

Referring further to FIG. 13, flat spring drive 26, 31 or 41 is mounted on transverse shafts 81, 82. The outer end of each shaft is mounted to the housing 11 and the opposite, inner end is mounted to longitudinal wall or support member 83. Of these spring drives, unit 26 is a conventional constant force or torque drive. However, spring drives 31 and 41 are unique variable force or torque units in accordance with the present invention, which preferably are specially adapted to provide a drive force which varies in direct proportion to the lift cord-supported blind weight or the pleat compressive force. That is, the spring force changes, preferably decreases, as the spring is unwound and the blind is extended toward the fully-down position and, conversely, increases as the spring is wound and the blind is retracted toward the fully-up position. (This is in direct contrast to the operation of coil springs, in which the spring force varies inversely to the variation of the cord-supported weight or compression of the blind.)

The output of the spring drive 26, 31, 41 is connected via power transfer bevel gear set 60 and transmission 70 to the cord pulleys 19-19. One gear 61 of bevel gear set 60 is mounted on drum mounting shaft 82 and meshes with the second gear 62, which is mounted on section 53 of shaft 50. The second bevel gear 62 is connected to the transmission 70, which is mounted on shaft section 53. The transmission varies the rate at which the cord pulleys 19 and 19 rotate relative to the rotating drum of the spring drive.

Illustratively, in one application, the transmission gear ratio is 3:1 to 8:1 so that lift cord pulleys 19-19 rotate 3–8 revolutions for each revolution of the rotating spring drive spool.

As alluded to, preferably, a varied force spring drive unit is used, one which exerts diminished force as the blind is lowered, and preferably one which tracks the decreasing supported weight or compression force of the blind 10, 20 as the blind is lowered. The above transmission gear ratios and the different pulley and spring rotation rates diminish proportionately the force exerted by the spring as it is wound and the blind is lowered. This permits the use of a more powerful spring to hold a large, heavy blind in position at the uppermost position, where the cord-supported weight is the greatest, and proportionately diminishes the force exerted by the spring at the lowermost, closed condition when the supported weight is a minimum, so that the powerful spring does not overpower the weight of the blind and does not uncontrollably raise the blind. The gear ratio also increases the length of travel available to the blind for a given spring, permitting a longer blind for a given spring or a given spring travel. (For example, for the described 3:1 ratio, the possible blind length is 3 times the maximum spring rotation.) Furthermore, the transmission 70 and the bevel gear set 60 have inherent friction which individually and collectively act as a brake and retain the blind at any selected position between and including fully open and fully closed. The combination of the preferably varied force spring drive, the transmission gear ratio and the gear friction allow the spring to hold the blind in position at even the "heaviest" (uppermost) blind positions, and allow the blind to be pulled downward to any selected position by gently pulling the blind to that position and, conversely, to be pushed upward to any selected position by gently pushing upward to that position. Little force is required to move the blind up and down, the blind stops accurately at any selected position between and including the fully open and fully closed positions, and the blind remains at the selected positions.

b. Spring Drive and Bevel Gears (FIG. 14)

Figure 14:
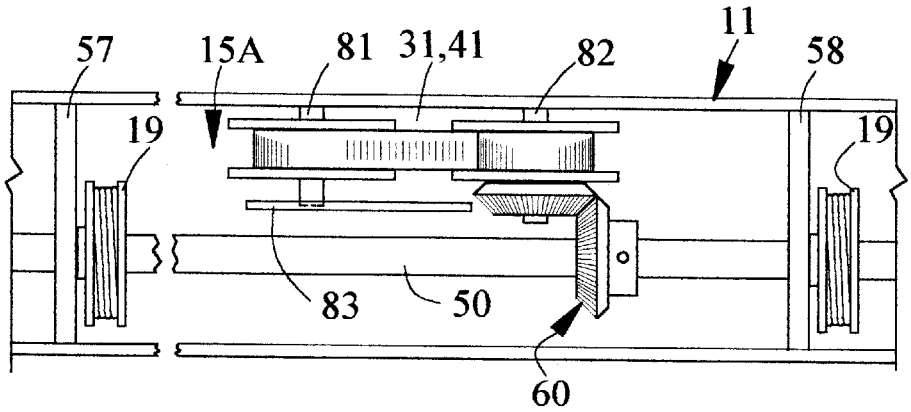

FIG. 14 depicts a spring drive unit 15A which is essentially unit 15, FIG. 13 without the transmission 70. Also, the shaft 50 depicted in the figure is of one-piece construction. A constant or varied force spring drive 26, 31, 41 is mounted on the transverse shafts 81 and 82, with shaft 82 also mounting bevel gear 61. Mating bevel gear 62 is mounted on the shaft 50 and, as a result, the shaft 82 and associated rotating spring drum are connected by the bevel gear set 60 directly to shaft 50 and the lift cord pulleys 19-19, and rotate at the same rate as the pulleys. Although a constant force spring drive can be used, a varied force drive is much preferred, to tailor the spring force to the blind weight or compression, as described above relative to FIG. 13. In addition, the bevel gear set 60 provides friction which assists the constant or the varied force spring drive in maintaining the blind at the selected positions. The bevel gear set 60 can be a 1:1 direct drive or a non-direct drive.

Figure 14D:
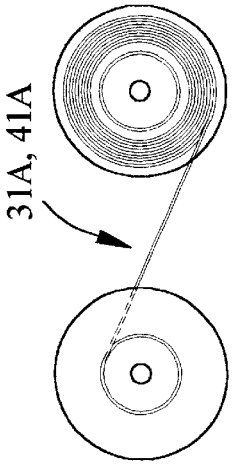
FIGS. 14C and 14D depict the wound/unwound condition of a spring drive when the associated cover or blind is in the raised and lowered position, respectively.
Figure 14C:
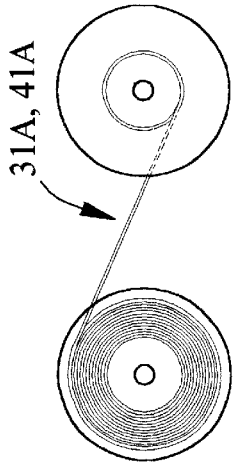
Figure 14B:
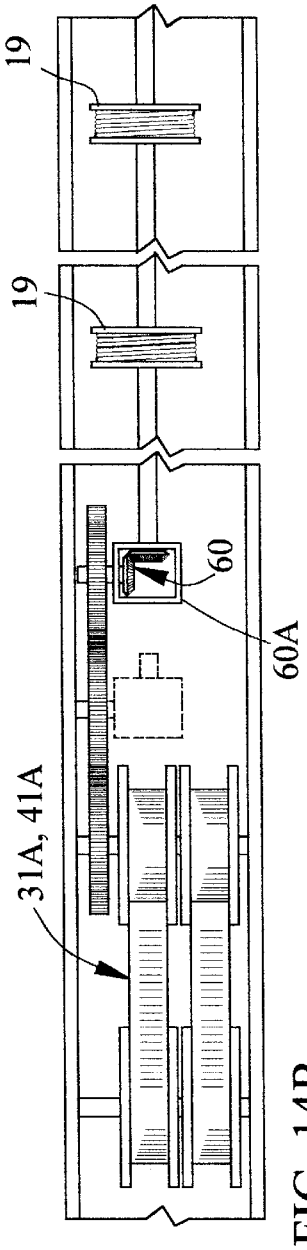
FIGS. 14A and 14B depict the use of bevel gear sets to interconnect non-parallel components such as the pulley(s) and spring drives.
Figure 14A:
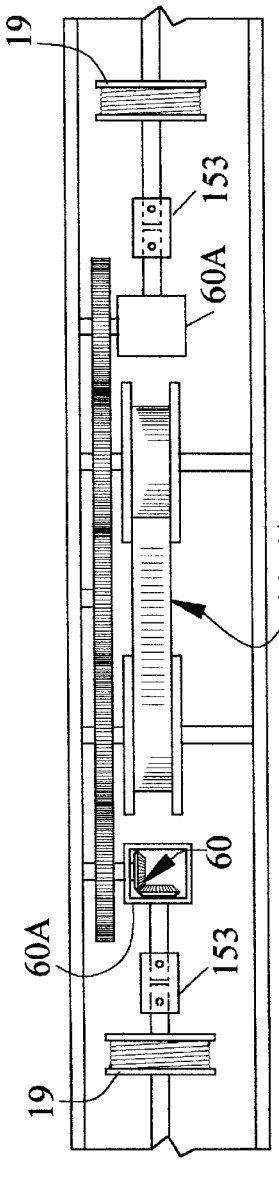

FIGS. 14A and 14B depict other applications of bevel gear sets 60 for transferring power/rotation when interconnected window lift components such as the pulley(s) and spring drive(s) are mounted on shafts which are non-parallel. FIG. 14A illustrates a spring drive such as 31 or 41 positioned intermediate spaced-apart end pulleys 19-19. The shafts at the opposite ends of the gear train are oriented 90° to the associated pulley shafts and are connected at each end to the associated pulley shaft by a bevel gear set 60 located in housing 60A. Illustratively, the pulley shafts comprise sections which are interconnected by removable connectors 153, thereby facilitating removal of the pulley(s) or the spring drive unit(s) without removing the other components.

FIG. 14B illustrates a spring drive such as 31A or 41A located on one side or end of the associated blind, and two spaced pulleys 19-19 mounted on the opposite side or end. The gear train shaft is oriented 90° to the associated pulley shaft and is connected to that pulley shaft by bevel gear set 60. The illustrated spring drive 31A, 41A comprises a pair of springs mounted in parallel on integral or joined storage spools and output spools, thereby providing increased torque.

FIG. 14C depicts the spring of drive 31A, 41A substantially fully wound on the storage (left) spool when the associated blind is at its topmost, fully raised (open) position, whereas FIG. 14D depicts the spring substantially fully wound on the output (right) spool when the associated blind is fully lowered (closed).

c. Spring Drive and Transfer Gears (FIG. 15)

Figure 15:
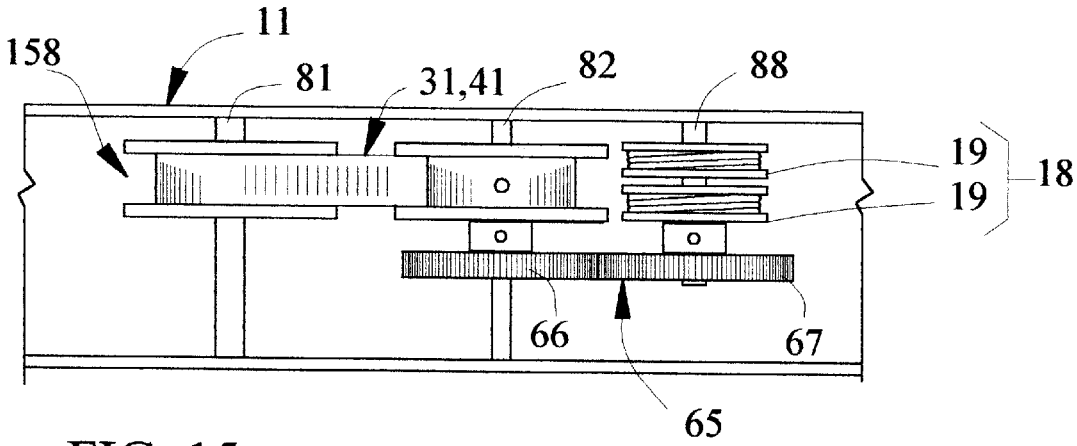

FIG. 15 depicts a spring drive unit 15B which is yet another alternative to the drive unit 15, FIG. 13. A constant or a varied force spring drive 26, 31, 41 is mounted on shafts 81, 82, which extend the entire width of the housing 11 and are supported by the longitudinal (front and rear) housing walls. Cord pulley set 18 comprises two pulleys 19-19 mounted adjacent the spring drive unit on shaft 88. The spring drive unit is directly connected to the cord pulley unit 18 by a power transfer spur gear set 65 comprising gear 66 which is mounted on spring drive drum shaft 82 and meshes with gear 67, which is mounted on cord pulley shaft 88. When a constant force spring drive is used, obviously the spring force does not track the blind weight or compression. However, the power transfer gear set (1) permits tailoring the spring drive unit to the blind operation in that the gear set 65 can be (a) a 1:1 direct drive so that the unit transmits power directly with only frictional loss, or (b) can have a selected non-direct gear ratio for varying the spring force as described above, and thus assisting in tailoring the spring force to the varying blind weight or compression, and (2) has inherent friction which assists retaining the blind at the selected positions. When a varied force spring drive unit is used, (1) preferably the varied force is tailored to the variation in the supported weight of the blind, (2) the power transfer gear set friction assists in retaining the blind at the selected positions, and (3) the power transfer gear set may be direct drive or have a gear ratio which assists in tailoring the spring force to the varied supported weight or compression characteristics of the blind.

Figure 33A:
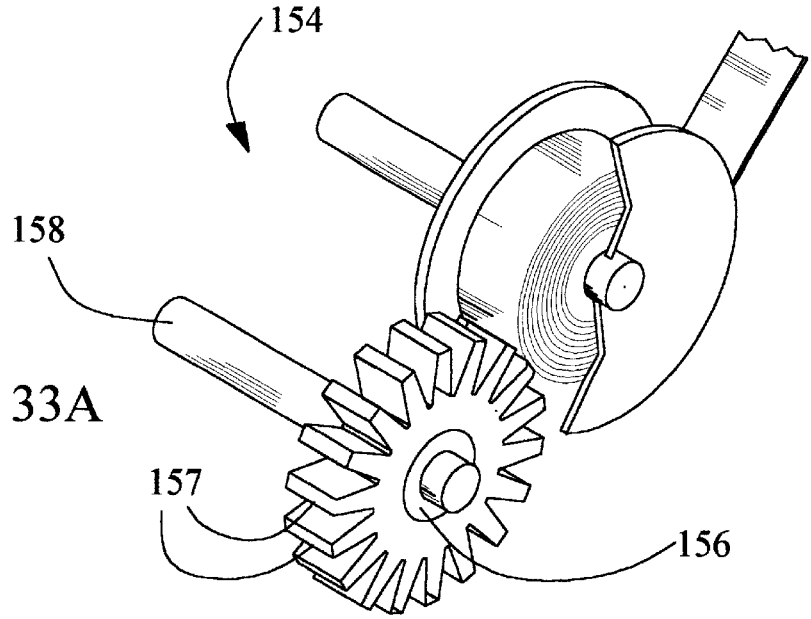
FIG. 33A depicts a braking device embodied in a recoiler roll
Figure 15A:
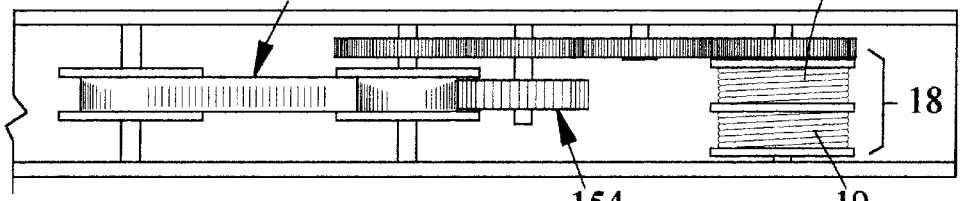
FIG. 15A depicts a spring drive unit which is similar to unit the unit depicted in FIG. 15, and includes a recoil roll.

FIG. 15A depicts a spring drive unit which is similar to unit 15B, FIG. 15, and includes a recoil roll or wheel or simply recoiler 154, FIG. 33A, mounted adjacent and in contact with the output spool of the spring drive 31, 41, for facilitating recoil of the spring when needed, preventing "explosion" of the spring, and providing braking action for supplementing the inertia of the unit to maintain the spring and associated window cover in the desired position. It is thought that springs having holes, slots, etc. are more likely to "explode" that are non-perforated springs and thus the recoiler is especially useful with perforated springs.

d. Spring Drive and Transfer Gears (FIG. 16)

Figure 16:
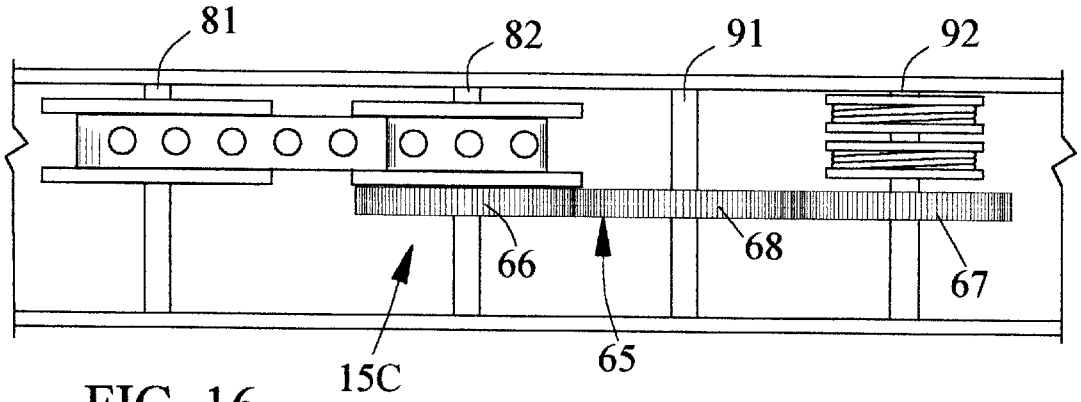

FIG. 16 depicts an alternative embodiment 15C to the spring drive unit 15B, FIG. 15. The compact unit 15C comprises the spring drive 26, 31, 41; the cord pulley unit, and power transfer spur gear set 65. The difference is that the housing 11 contains four shafts 81, 82, 91 and 92, and the power transfer gear set 65 comprises three gears 66, 67, 63. Gear 66 is mounted on shaft 82 as in FIG. 15, and gear 67 is mounted on shaft 92 with pulley set 18. However, middle gear 68 is mounted on shaft 91. The three gear unit 65 operates differently from the two gear unit in that it is a power transfer and/or ratio unit. Otherwise, the unit 15C operates the same as unit 15B, FIG. 15, and the components function as described above with regard to unit 15B.

e. Spring Drive, Band Shift Transmission and Transfer Gears (FIG. 17)

FIG. 17 depicts a compact spring drive unit 15D which is yet another alternative to the drive unit 15, FIG. 13. The housing 11 contains transverse shafts 81, 82, 91 and 92. Spring drive 26, 31 or 41 is mounted on shafts 81 and 82 and is connected to cord pulley unit 18 by a power transfer gear unit 65 and a band shift transmission or gear unit 21. The power transfer gear unit 65 comprises gear 66 which is mounted on drum shaft 82 and meshes with gear 67, which is mounted on shaft 91. One drum 22 of the band shift transmission 21 is also mounted on the shaft 91 and the second drum 23 is mounted on shaft 92 along with the cord pulley unit 18, which comprises two cord pulleys 19-19 for the lift cords 16 and 17.

When a constant force flat spring drive 26 is used, the unit 15D has several features which improve the operation of the blind despite the limitation of constant spring drive force: (1) the band shift transmission 21 varies the spring force, preferably directly proportional to the varying weight or compression of the blind, (2) the power transfer gear unit 65 may be direct drive or may have a selected gear ratio for additionally varying the spring force as described above, and (3) the power transfer gear unit also provides friction which assists in retaining the blind at the selected positions. Alternatively, when a varied force flat spring drive unit is used, (1) the varied force of the spring drive preferably is directly proportional to the varying weight or compression of the blind, (2) the band transmission provides additional variation of the spring force, preferably directly proportional to the weight or compression of the blind, (3) the power transfer gear unit may be direct drive or may have a selected gear ratio for additionally varying the spring force and (4) the power transfer gear unit also provides friction which assists retaining the blind at the selected positions.

f. Spring Drive, Transmission and Transfer Gears (FIG. 18)

FIG. 18 depicts a compact spring drive unit 15E which is another embodiment of the present invention. The unit 15E comprises a flat spring drive 26, 31 or 41 which is operatively connected to a two-gear power transfer unit 65, which in turn transmits force via transmission 70 to the pulley unit 18, and vice versa. Specifically, the spring drive is mounted on transverse shafts 81, 82; one gear 66 of the set 65 is mounted on the shaft 82 with the associated drum and meshes with the gear 67, which is mounted on shaft 92. Transmission 70 is also mounted on the shaft 92 in the manner described relative to the mounting on shaft 50, FIG. 13, along with the pulley unit 18. As a result, the power transfer gear unit 65 and the transmission 70 transfer force from the spring drive to the pulley unit, and vice versa.

Preferably, a varied force spring drive unit is used, one which exerts diminished force as the blind is lowered, and preferably one which tracks the decreasing supported weight or compression force of the blind 10, 20 as the blind is lowered. The above transmission gear ratios and the different pulley and spring rotation rates diminish proportionately the force exerted by the spring as it is wound and the blind is lowered. The gear ratio also increases the length of travel available to the blind for a given spring, permitting a longer blind for a given spring or a given spring travel. As discussed previously, the power transfer gear unit may be direct drive or may have a selected gear ratio for additionally varying the spring force. Furthermore, the transmission and the power transfer gear set have inherent friction which individually and collectively act as a brake and retain the blind at any selected position between and including fully open and fully closed.

g. Spring Drive, Transmission, Band Shift Transmission and Transfer Gears (FIG. 19)

FIG. 19 depicts an embodiment 15F of the spring drive unit which includes a chain drive for the purpose of transferring power and/or ratio. Illustratively, spring drive 26, 31 or 41 is mounted on shafts 81 and 82; band shift transmission 21 is mounted on shafts 82 and 91; chain drive 94 is mounted on shafts 91 and 92; two pulley units 18, 18 are mounted on shaft 92 for the purpose of powering the cord pulleys; and transmission 70 is mounted on shaft 91 between unit 21 and chain drive 94. The unit 15F features the combination of varied drive force from the spring drive, varied gear ratio from unit 21, constant gear ratio from transmission 70, and frictional holding force from transmission 70.

h. Additional Perforated Spring Embodiments (FIGS. 20–32)

FIGS. 20–32 depict several of the many possible additional embodiments of the perforated spring 44, FIGS. 8 and 12.

In FIG. 20, spring 44A comprises an array of elongated slots of generally uniform size positioned along the longitudinal center axis of the spring.

The spring 44B of FIG. 21 comprises a similar array of uniform elongated slots, flanked by a line of alternating holes along each outside edges of the spring, with the holes in each line being spaced one hole per two slots.

The spring 44C of FIG. 22 has a similar array of uniform elongated slots, flanked by two lines of holes along the outside edges of the spring, with a hole at each end of the individual slots.

FIG. 23 depicts a spring 44D comprising an array of elongated slots of increasing length positioned along the longitudinal center axis of the spring.

In FIG. 24, spring 44E comprises an array of generally circular holes of the same size positioned along the longitudinal center axis of the spring.

The spring 44F of FIG. 25 comprises an array of generally circular, like-sized holes positioned along the longitudinal center axis of the spring, flanked by lines of alternating holes along the outside edges of the spring, with the holes in each line spaced one hole per two slots.

The spring 44G of FIG. 26 comprises an array of generally circular holes of uniform size positioned along the longitudinal center axis of the spring, flanked by a line of alternating holes along each outside edge of the spring, with the holes in each line being spaced one hole per slot.

In FIG. 27, spring 44H comprises five longitudinal lines of generally circular holes of like size, with the holes of adjacent lines positioned at alternating positions along the spring.

FIG. 28 depicts a spring 441 comprising an array of generally circular holes of increasing radii positioned along the longitudinal center axis of the spring.

In FIGS. 20–22 and 24–26, one end of the spring does not have slots, so that the spring torque or force maintains a relatively constant maximum along the slot-free end.

FIGS. 29 and 30 depict a perforated spring 44K illustratively comprising three sections 112, 113 and 114 which are joined by a tongue-in-groove arrangement 116 (sections 112 and 113) and rivet 117 (sections 113 and 114). The spring torque is controlled by the different cross-sectional dimensions of the sections as well as the size and spacing of the perforations.

FIGS. 31 and 32 depict an alternative, non-perforated sectioned spring 44L, illustratively comprising three sections 118, 119 and 121 which are joined by rivets 122 (sections 118 and 119) and a link 123 (sections 119 and 121). The spring torque is controlled by the cross-sectional dimensions of the sections.

Figure 42:
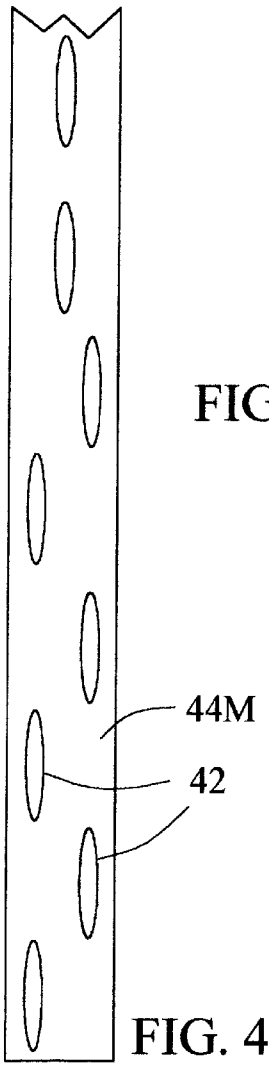

FIG. 42 depicts yet another alternative perforated spring 44M which, illustratively, comprises two laterally spaced parallel rows of longitudinally spaced, longitudinally elongated slots 42. The length of the slots and the spacing between the slots are selected to vary the torque output of the spring along the length of the spring. Slots are preferred to holes because the elongation of the slots has a more uniform cross-section along the width of the spring than circular holes and thus more uniform torque along the length of the slots. FIG. 42A depicts still another perforated spring, an embodiment 44N comprising longitudinally-overlapping elongated slots 42A having round, semi-circular ends 42B. The long, rounded end, overlapping slots enhance the uniformity of the spring cross-section along its width and thus provide uniform (uniformly constant or uniformly varied) torque.

i. Magnetic and Detent Brake Embodiments (FIGS. 33–37)

Figure 33:
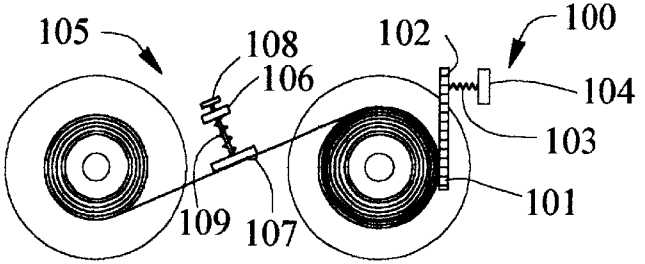
FIGS. 33–37 depict magnetic and detent brakes and components useful in spring drives.
Figure 34:
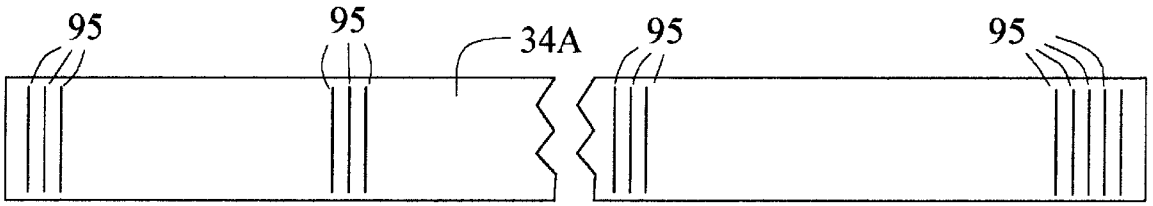
Figure 35:
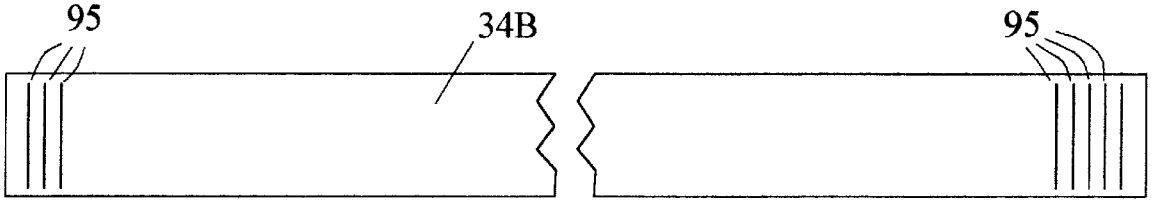
Figure 36:
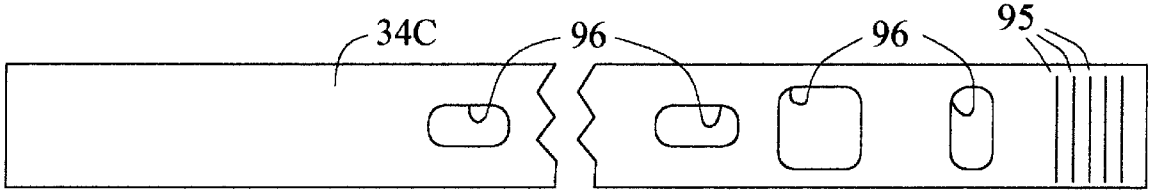
Figure 37:
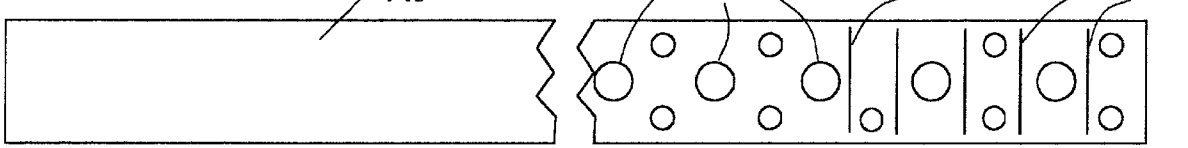

FIGS. 33–37 illustrate the use of magnetic and detent brakes in spring drives. FIG. 33 depicts a spring drive which incorporates two brake devices, a magnet brake 100 and a detent brake 105. Both devices are shown in one figure, although either one or both devices can be used. Regarding magnet brake 100 and referring also to FIGS. 34–37, the spring contains thin magnetic or magnetized sections 95 which in the illustrated embodiment extend transverse (side-to-side) on the spring. Preferably, several of the sections are placed closely adjacent one another at locations of the spring where it is desired to stop the spring, for example at spring positions corresponding to blind fully open and fully closed positions and intermediate positions, including a large number of closely spaced intermediate stop positions. For example, FIG. 34 depicts a varied-cove spring embodiment 34A having magnet strip 95-defined stop positions at a multiplicity of positions. FIG. 35 depicts an embodiment 34B having magnet strip 95-defined stop positions proximate the ends of the spring. FIGS. 36 and 37 illustrate springs 34C and 44J, respectively, having magnet strip 95-defined stop positions at one end of the spring.

Referring now to FIG. 33, the exemplary magnet brake 100 comprises a magnet bar 101 mounted for pivotal movement by pin or shaft 102 which is mounted to the housing 11. Spring 103 is mounted to bar or rod 104 extending from the housing and biases the magnet bar lightly closely adjacent the outside surface of spring such as spring 34A, 34B, 34C and 44J wound on associated drum such as 28. The magnet bar 101 rides lightly along or in close proximity to the spring with no effect on the operation of the spring drive until the bar reaches the magnet sections 95, which are attracted to the bar. Preferably, the magnetic force is sufficient to maintain the spring drive and blind at the given position when the blind is brought to rest at that position, and is sufficient to stop a very slowly moving blind at that position (that is, to stop the blind as a person slows movement of the blind to stop it proximate the position of the magnet strips), but is insufficient to stop the blind as it is raised and lowered at a normal speed.

The detent brake 105 shown in FIG. 33 comprises a bar 106 extending in a transverse direction from the housing 11 adjacent the spring between the associated drums, a detent 107 mounted on a pin 108 projecting downward through a hole in the bar 106, and a spring 109 between the bar 106 and the detent 107 for biasing the detent lightly against the spring. As shown in FIG. 36, the spring 34C may comprise one or a plurality of holes 96 which accept the detent 107. Alternatively, referring to FIG. 37, holes at selected positions in the perforation-derived varied force spring may be of suitable size to accept the detent. The detent 107 has a sloping tip which engages the selected holes with force which is sufficiently great to maintain the spring drive and blind at the given position when the blind is brought to rest at that position, and is sufficiently great to stop a very slowly moving blind at that position (that is, to stop the blind as a person slows movement of the blind to stop it proximate the position of the magnet strips), but is sufficiently small (that is, the detent is sufficiently easy to dislodge from the selected holes) to stop the blind as it is raised and lowered at a normal speed.

FIG. 33A depicts a braking device in the form of a recoiler roll or recoiler wheel or simply recoiler 154 comprising a hub 156 and a multiplicity of fins 157–157 which extend from the hub, illustratively generally radially. The hub 156 and fins 157 can be formed as an integral unit. Preferably at least the fins (or the fins and the hub) are formed of resilient material such as rubber. The recoil hub is mounted on a shaft 158. The recoiler 154 is mounted adjacent and in contact with an associated spool of a spring drive such as 31, 41, for facilitating recoil of the spring when needed, preventing "explosion" of the spring, and providing braking action for supplementing the inertia of the spring drive unit to maintain the spring and associated window cover in desired positions.

Figure 33B:
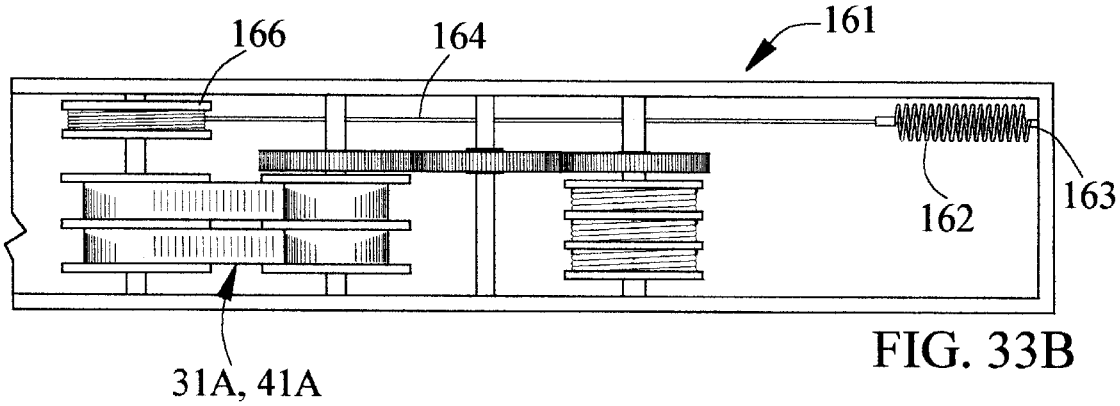
FIG. 33B depicts yet another braking device, one embodied in a coil spring recoiler.

FIG. 33B depicts another recoiler, embodied in a coil spring recoiler 161 comprising a coil spring 162 attached at one end 163 to the wall of the blind housing and connected at the opposite end to a cord or wire 164 which is wound on a spool 166 mounted coaxially with the storage spool of an associated spring drive such as 31A, 41A. The coil spring recoiler 161 opposes the unwinding of the spring and facilitates recoiling of the spring when needed, preventing "explosion" of the spring, and provides braking action for supplementing the torque and inertia of the spring drive unit to maintain the spring and associated window cover in desired positions.

j. Large Dimension and Heavy Window Cover Systems (FIGS. 38–41)

FIGS. 38–41 illustrate examples of the use of spring drive units embodying the present invention in large window covers, for example, heavy covers or wide covers.

Figure 38:
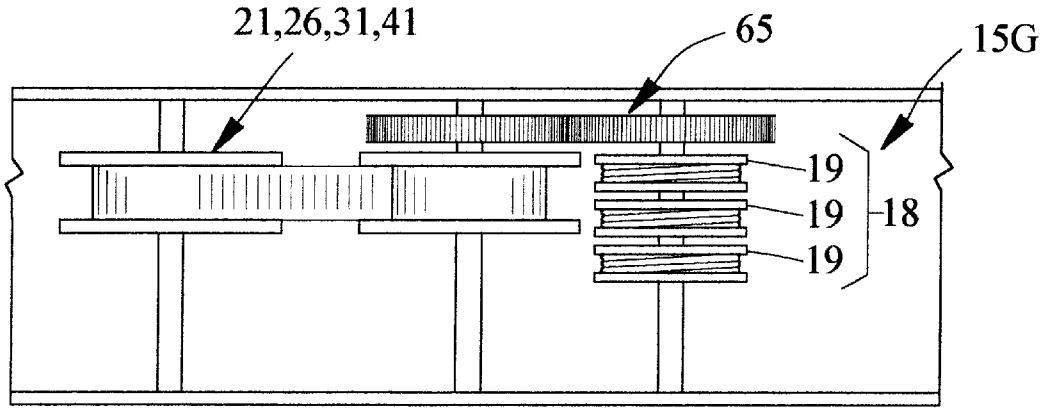
FIG. 38 depicts a single spring drive unit which includes three lift cords and pulleys.

FIG. 38 depicts a single spring drive unit 15G which includes three lift cords and pulleys. The illustrated drive unit includes a spring drive such as 26, 31, 41 which is connected by a gear set 65 to the shaft on which the three lift cord pulleys 19 are mounted. Typically, the associated cords are routed along vertical paths which are spaced along the width of the wide and/or heavy cover, for uniform raising and lowering of the cover.

Figure 39A:
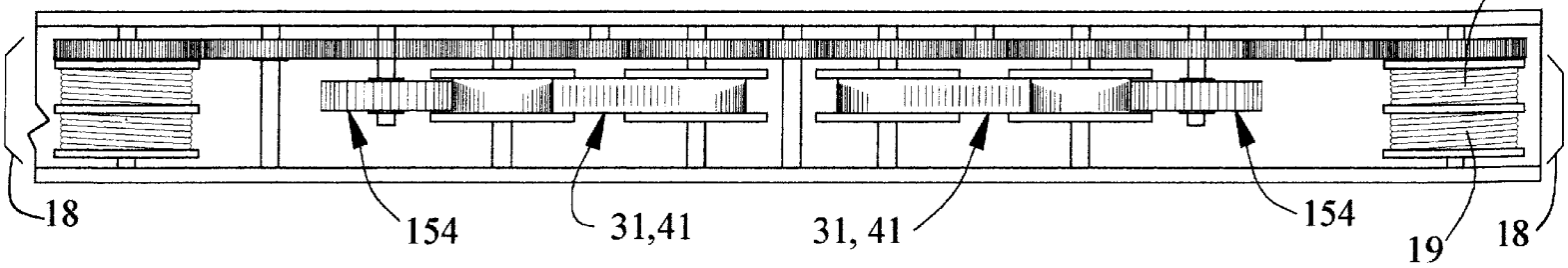
FIG. 39A depicts a multiple spring drive unit which includes a recoiler unit of the type depicted in FIG. 33A.
Figure 39:
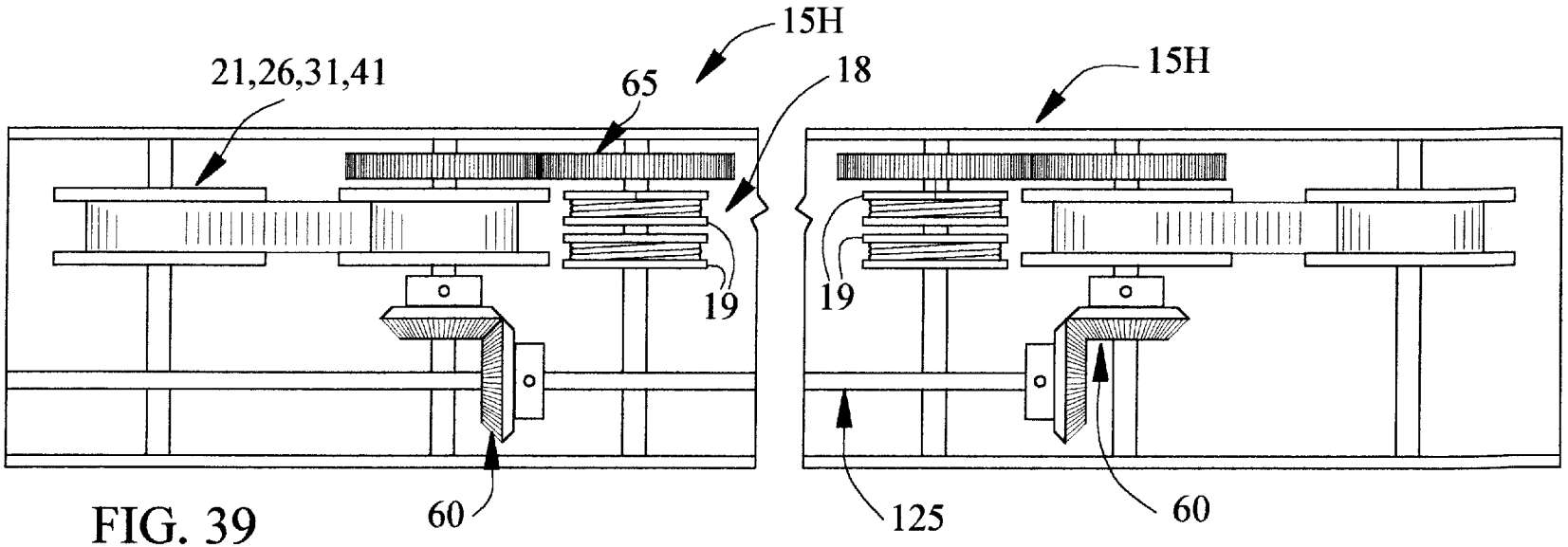
FIG. 39 depicts a window cover which includes a pair of drive units, each of which is similar to that of FIG. 38, but includes two pulleys and associated lift cords.

FIG. 39 depicts a plural (two or more) drive unit, spring drive window cover system which includes a pair of drive units 15H, each of which is similar to that of FIG. 38, but includes two pulleys 19 and associated lift cords. The spring drives are connected by a power transfer bar unit 125 having bevel gear units 65 on the opposite ends which are connected to the rotating shaft of each spring drive, so that the drives, pulleys, and cords operate precisely in unison. The four illustrated pulleys 19 can be used to route four lift cords along vertical paths which are spaced along the width of the cover, for uniformly raising and lowering the wide and/or heavy cover (See FIG. 41).

FIG. 39A depicts a plural drive unit, spring drive window cover system which is similar to that of FIG. 39, in that the spring drive system includes two single-spring, spring drive units 31 or 41 and two pair of outer pulleys. The illustrated spring drive units 31 (41) are connected in series by a drive train to two-pulley units 18-18 mounted on either side of the spring drive units. The arrangement is well suited to placing plural spring drive units in the interior or middle of the window cover between left and right end pulleys. The window cover drive system also includes a pair of recoilers 154-154, one mounted adjacent and in contact with the farthest left and farthest right spools of the spring drive units. The recoilers 154-154 facilitate recoil of the associated spring when needed, prevent "explosion" of that spring, and provide braking action for supplementing the inertia of the spring drive units to maintain the springs and associated window cover in desired positions.

Figure 40A:
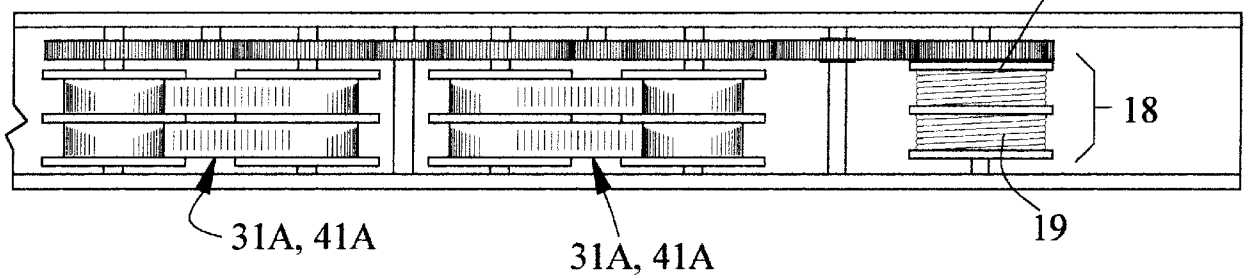
FIG. 40A depicts an increased torque window cover drive system similar to that of FIG. 40, in which each spring drive comprises a pair of springs mounted in parallel.
Figure 40:
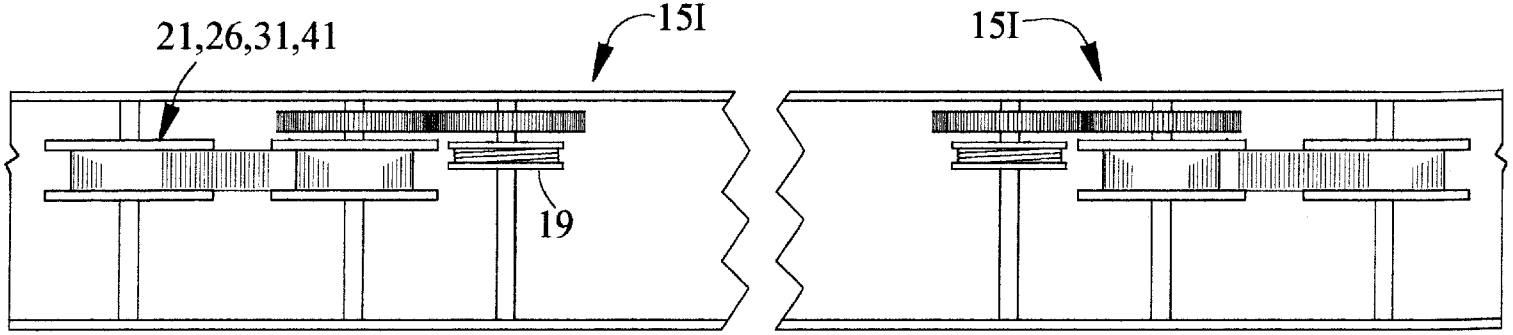
FIG. 40 depicts a window cover comprising a pair of spring drive units similar to those of FIG. 38 without the power transfer bar and with only one pulley in each drive unit.

FIG. 40 depicts a plural drive unit, spring drive system comprising a pair of spring drive units 151 similar to the units 15G of FIG. 38, but with only one pulley 19 in each unit. This system is used for a two lift cord system, typically for heavy covers.

FIG. 40A depicts a plural drive unit, spring drive system which includes two spring drive units and a two pulley unit 18 on one side of the spring drives. A gear train is connected between the output spool of each drive unit and the associated pulley unit. Each spring drive 31A or 41A comprises a pair of springs mounted in parallel on a single storage spool (or integral/joined storage spools) and a single output spool (or integral/joined output spools).

Figure 45:
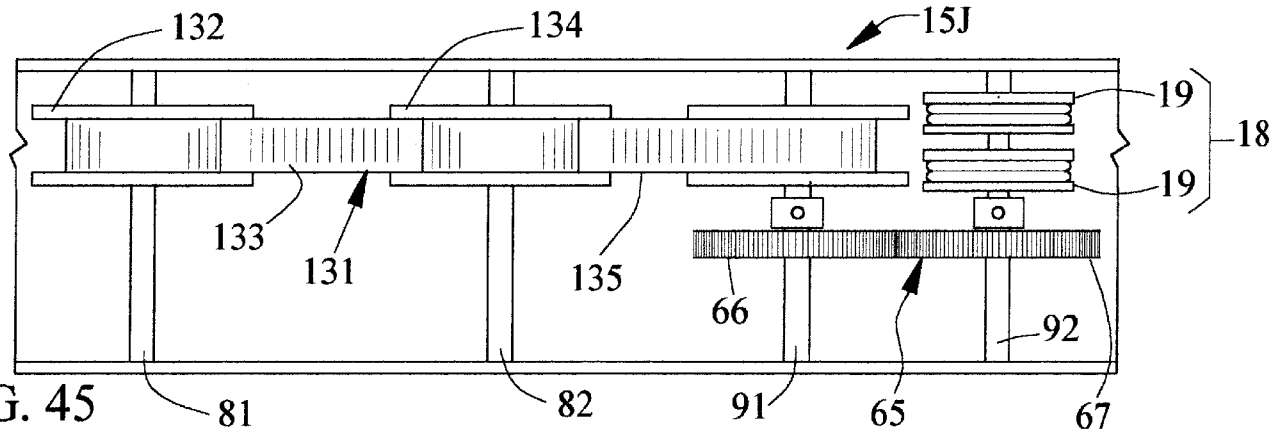
FIG. 45 is a top plan view of a spring drive unit embodying the plural spring drives of FIG. 43.
Figure 52:
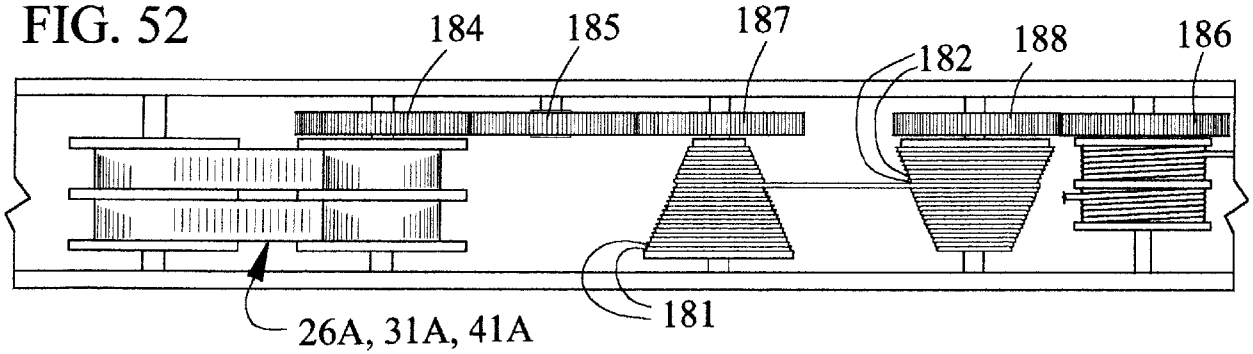
FIG. 52 is a top plan view of a section of a simple high torque spring drive system which includes the varied ratio cord pulley of FIG. 51.

At this point, a note regarding spring drive terminology may be helpful. First, herein the phrases "plural drives," "plural drive units," "plural drive unit, spring drive system" and the like refer to a system comprising two or more spring drive units. See, for example, FIGS. 39, 39A, and 40, which depict different arrangements of window cover systems, each of which includes two spring drive units such as 26, 31 or 41. Second, the phrases "plural-spring unit," "plural-spring drive unit," "plural-spring, spring drive unit" and the like refer to an individual spring drive unit which comprises two or more springs. See, for example, FIGS. 45 and 52, wherein each of the spring drive units 26A, 31A, 41A and 131 comprises two springs. In FIG. 45, the two springs of the spring drive unit 131 have separate storage spools 132 and 134 and a common output spool 136. In FIG. 52, the spring drive unit 26A (or 31A or 41A) comprises two springs mounted in parallel on a single storage spool (or integral/joined storage spools) and a single output spool (or integral/joined output spools). Finally, please note that systems can comprise plural drive units, of which one or more is a plural-spring drive unit. See, for example, FIG. 40A. The plural-spring drive unit; plural drive unit systems; and combinations thereof are used to increase the torque/force available for operating heavy coverings and to provide separate drive units near the cord pulleys in wide coverings.

Figure 41:
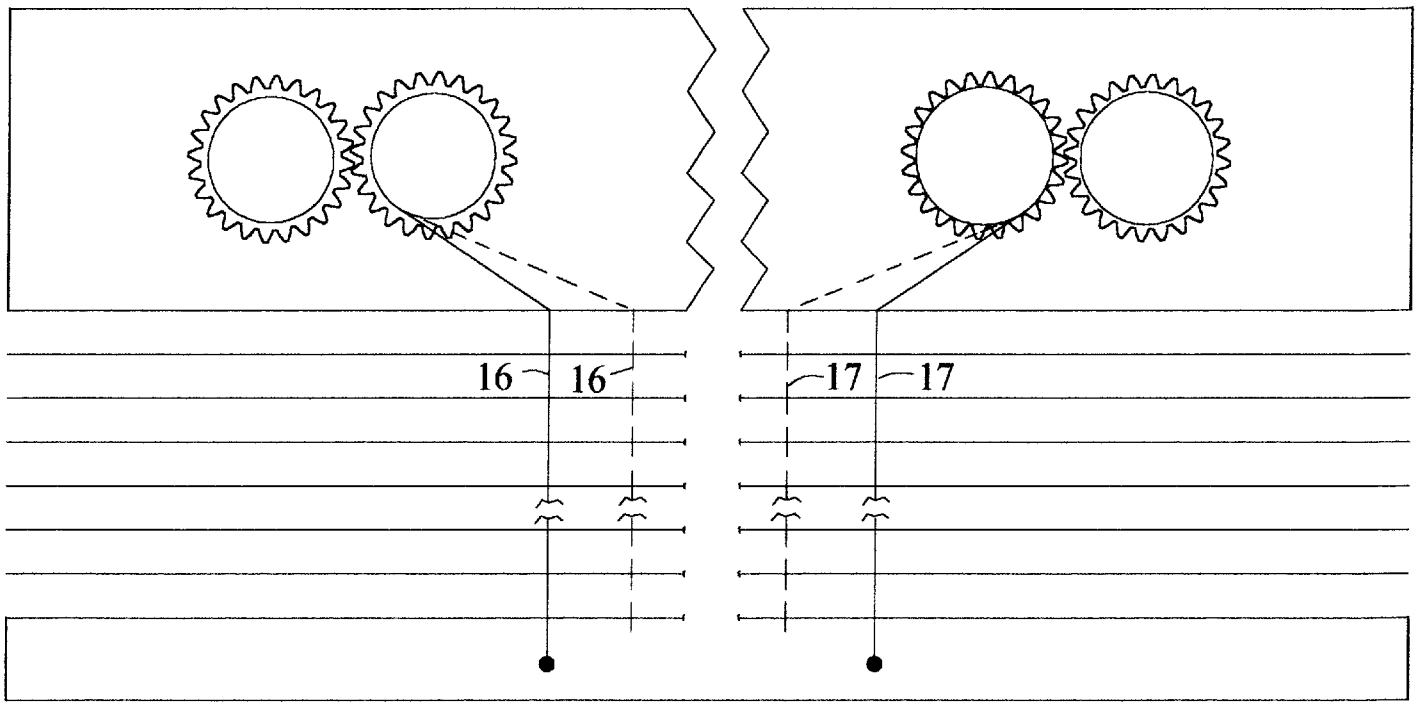
FIG. 41 depicts representative examples of the lift cord paths for two and four cord systems.

FIG. 41 depicts representative examples of the lift cord paths for two and four cord systems.

Figure 49:
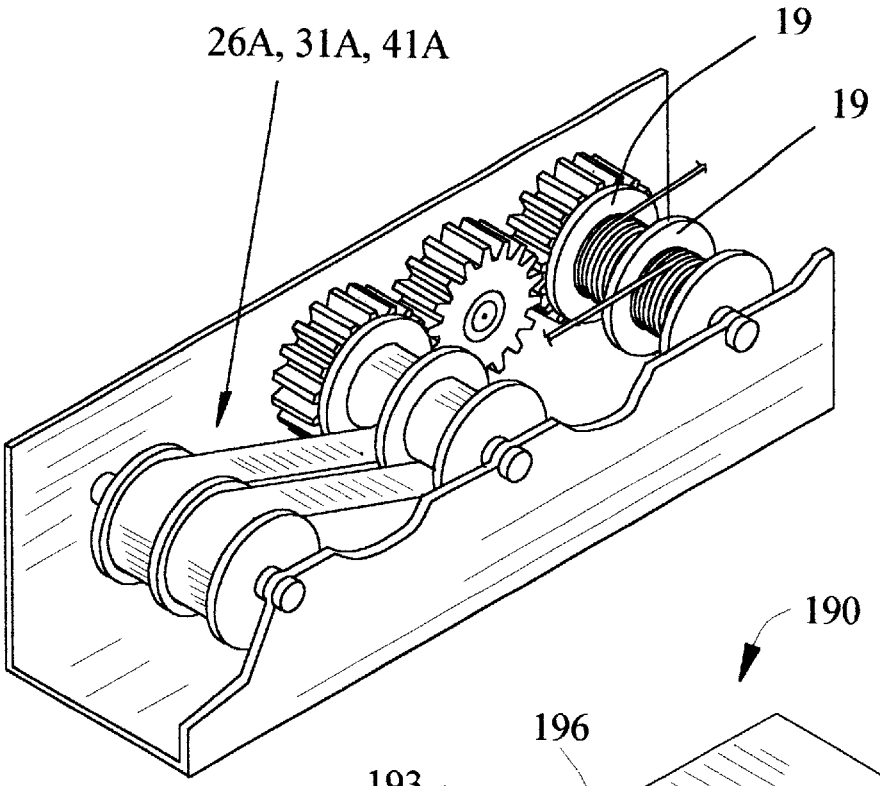
FIGS. 49 and 50 are, respectively, a front perspective view, partially broken away, and a top plan view of a compact, simple, plural-drive high torque spring drive system.
Figure 50:
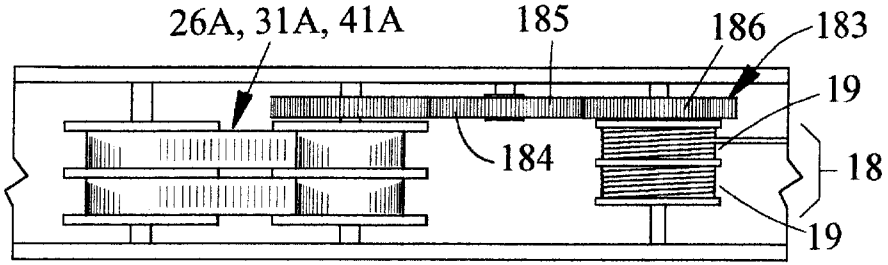

FIGS. 49 and 50 are a front perspective view, partially broken away, and a top plan view of a compact, simple high torque spring drive system. A varied torque spring drive 31A or 41A or, preferably, a constant torque drive unit 21A is used which comprises a pair of springs mounted in parallel on integral or joined storage spools and output spools, and thereby provides increased torque for positioning heavy blinds. The spring drive is connected via a direct drive or varied transfer gear train 183 comprising gear wheels or sprockets 184, 185, 186 to a pulley unit 18 comprising pulleys 19-19 mounted on a shaft which is parallel to the shafts of the output and storage spools and transverse to the housing.

Figure 51:
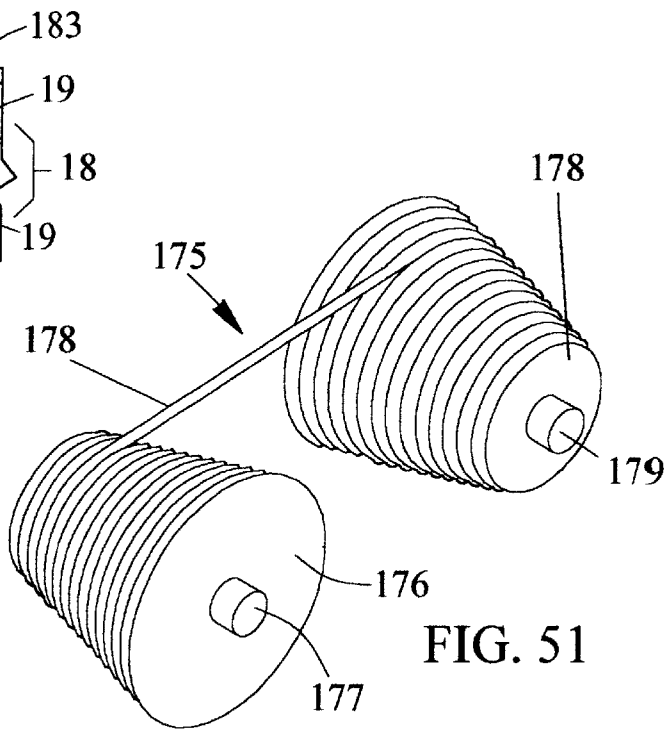
FIG. 51 is a perspective view of a direct or varied ratio cord pulley system.

FIG. 51 is a perspective view of an embodiment of a direct or varied ratio cord pulley system 175, comprising a pair of pulleys or spools 176 and 178 having selected diameters at different axial positions for precisely controlling their ratio. Illustratively, the pulleys 176 and 178 are reverse oriented, conical pulleys or spools 176 and 178. The spools are mounted for rotation on shafts 177 and 179 which correspond to the spool axes and have continuous grooves 181 and 182, FIG. 52, which wind axially around the for receiving cord 178 and preferably winding cord as a single layer. The pulley system 175 operates similarly to the flat band transmission system 21, except that the diameter of each of the spools 176 and 178 can be varied with respect to their longitudinal axes so that as the spools are wound and unwound, their ratio at a given covering/blind position is determined by the spool diameters at the axial cord position corresponding to the covering/blind position, not by the diameter of the wound cord layers, and thus their ratio can be varied precisely over a wide range of values.

It is to be emphasized that the pulley system 175 is not limited to conical shapes. Rather, the shape is that which provides the desired diameter ratios axially along the spools. The force requirements for a given system may best be accommodated by decidedly non-conical configurations. Generally, the output-controlled configuration of the spools is an elongated cylinder of controlled and selectively varying axial diameter.

FIG. 52 depicts the compact drive system of FIGS. 49 and 50, modified by the inclusion of a varied ratio cord pulley system 175. In this embodiment, the pulley system shafts 177 and 179 are mounted to sprockets 187 and 188 which are inserted between the pulley sprocket 186 of the gear train and the intermediate sprocket 185 of the gear train. The result is a compact drive system which nonetheless has high maximum torque that can be varied over a wide range of values to accommodate the changing supported weight of a heavy window cover.

k. Plural Spring, Spring Drive System (FIGS. 43–45, 53–57)

Figure 44:
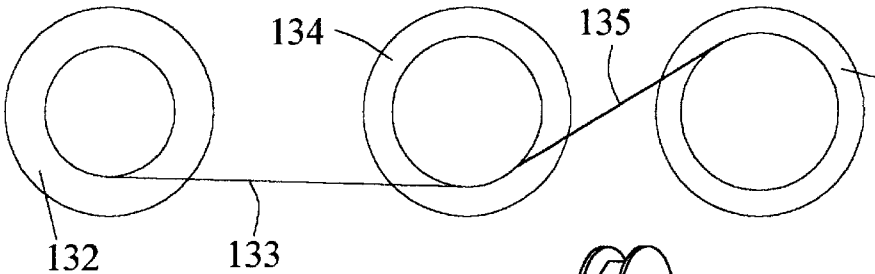
FIG. 44 is a simplified front elevation depiction of FIG. 43 illustrating the relationship of the two spring drives and their overlapping springs.
Figure 43:
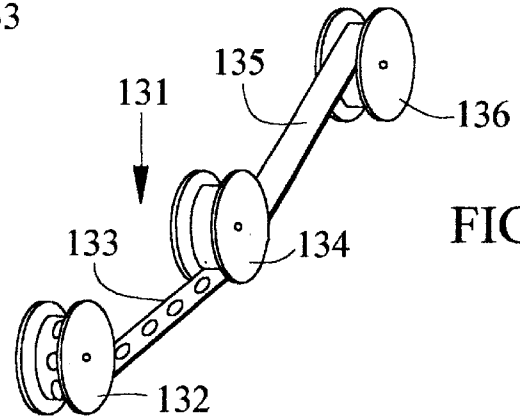
FIG. 43 is a perspective view of a varied torque, torque-multiplying, plural flat spring drive in accordance with the present invention.

FIGS. 43–45 depict a compact spring drive system 15J embodying the present invention and comprising integrally formed plural spring drives. The spring drive system comprises plural (two or more) spring drives which share components and are aligned along the width of the associated blind. This integrated alignment provides force multiplication without increasing the size of the associated housing 11 and, specifically, without requiring a taller housing 11. Referring specifically to FIGS. 43 and 44, the illustrated two spring, spring drive system 131 comprises a first spring drive comprising storage drum or spool 132, common output or power drum or spool 136 and spring 133. The second spring drive comprises storage drum or spool 134, common output or power drum or spool 136 and spring 135. As perhaps best shown in FIG. 44, the spring 133 is routed from its storage drum 132 beneath the drum 134, from which point the two springs are routed together, with spring 133 under spring 135, over and around common output or power drum 136. In effect, the individual torques of the plural springs are added together. The two storage spools are mounted for independent rotation so that outer spool 132 can rotate faster than inner spool 134. This is because the diameter of spring 133 on spool 136 is greater than the diameter of spring 135 and thus spring 133 rotates faster on its spool 132 than does spring 135 on its spool 134. Different types of springs can be used. For example, illustrated spring 135 is a conventional flat spring which provides substantially constant torque, and spring 133 is perforated so that the torque varies along the length of the spring proportional to the operational characteristics of the associated blind, as discussed previously. The combined springs provide a combined increased, varying torque sufficient for supporting heavy blinds, yet tailored to the different force requirements as the blind is raised and. lowered.

FIG. 45 depicts one embodiment 15J of a spring drive unit which uses the two spring, spring drive 131. The three spools 132, 134 and 136 are mounted on transverse shafts 81, 82, 91, respectively, spaced along the width (horizontally) of the associated housing 11. Gear 66 of gear set 65 is mounted on shaft 91 with the output or power spool 136 and meshes with gear 67, which is mounted on shaft 92 along with the cord pulley set 18 comprising right and left side cord pulleys 19, 19. Of course, the other components such as transmissions 50 and 70 and bevel gear set 60 can be used for transferring power from the spring drive to the cord pulleys and controlling the applied power, the travel of the blind relative to that of the spring drive, and the inherent, braking action. Furthermore, three or more springs can be used by the simple expedient of providing additional storage drums or spools and routing their associated springs together over and around the common output or power spool 136. For example, a third spring can be added to the drive 131, FIG. 43 and 44 by adding a third storage spool spaced generally horizontally to the left of spool 132, and routing the third spring beneath spring 133. Please note, as alluded to previously, this presents the opportunity to multiply the torque without increasing the size of the spools and the height of the housing 11. In contrast, in the plural spring system, the torque is increased by substantially a factor of two simply by adding a second spring the same size as the first spring. In effect, the increased spring mass required to multiply the torque can be provided by adding additional springs positioned along the horizontal axis of the spring drive, rather than by increasing the spring mass and spool diameter (and thus the height of the spool and the housing), as is the case where a single spring, spring drive is used.

In the embodiment shown in FIG. 45, the storage drums are arranged in a horizontal straight line, or approximately a straight line. In addition, both the output drum and the storage drums are arranged along the horizontal straight line. Alternatively, the storage drums or both the output drum and the storage drums can be positioned along a vertical line. Alternatively, the storage drums can be arranged in a cluster, or both the output drum and the storage drums can be arranged in a cluster.

Figure 53:
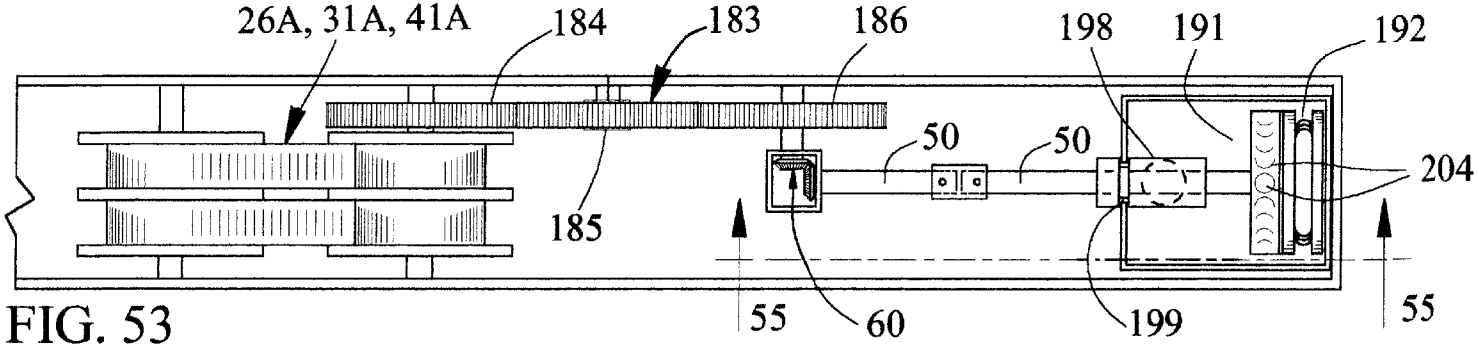
FIG. 53 is a top plan view of a section of a simple high torque spring drive system which includes the automatic cord locking mechanism of FIG. 54.

FIG. 53 is a top plan view of a section of a simple high torque spring drive system. A varied torque spring drive 31A or 41A or, preferably, a constant torque drive unit 26A is used which comprises a pair of springs mounted in parallel on integral/joined storage spools and output spools. The spools are mounted on shafts which are oriented transverse to the housing. The plural spring, drive system provides increased torque for operating heavy blinds. The spring drive is connected via a direct drive or varied ratio transfer gear train 183 comprising gear wheels or sprockets 184, 185, 186 to a locking pulley cord unit 190, FIG. 54, which includes a pulley 191 and raise/lower cord 192 wrapped around the pulley. In the exemplary drive system, the pulley shaft 50 is oriented transverse to, 90° relative to, the spring drive shafts and the shafts of the transfer gears 183, and is connected to the shaft 186 of the output pulley by a 90° bevel gear unit 60. The pulley cord unit 190 is used to operate the associated window cover or blind, that is, to raise and lower the window cover, and incorporates an automatic locking mechanism that prevents accidental movement of the blind, yet is easily and automatically overridden when the pulley cord system is operated. Although the locking draw system 190 is desirable in heavy and/or high torque window cover systems, it is applicable in general to window cover and other systems where a shaft is rotated by a pulley cord system.

Figure 54:
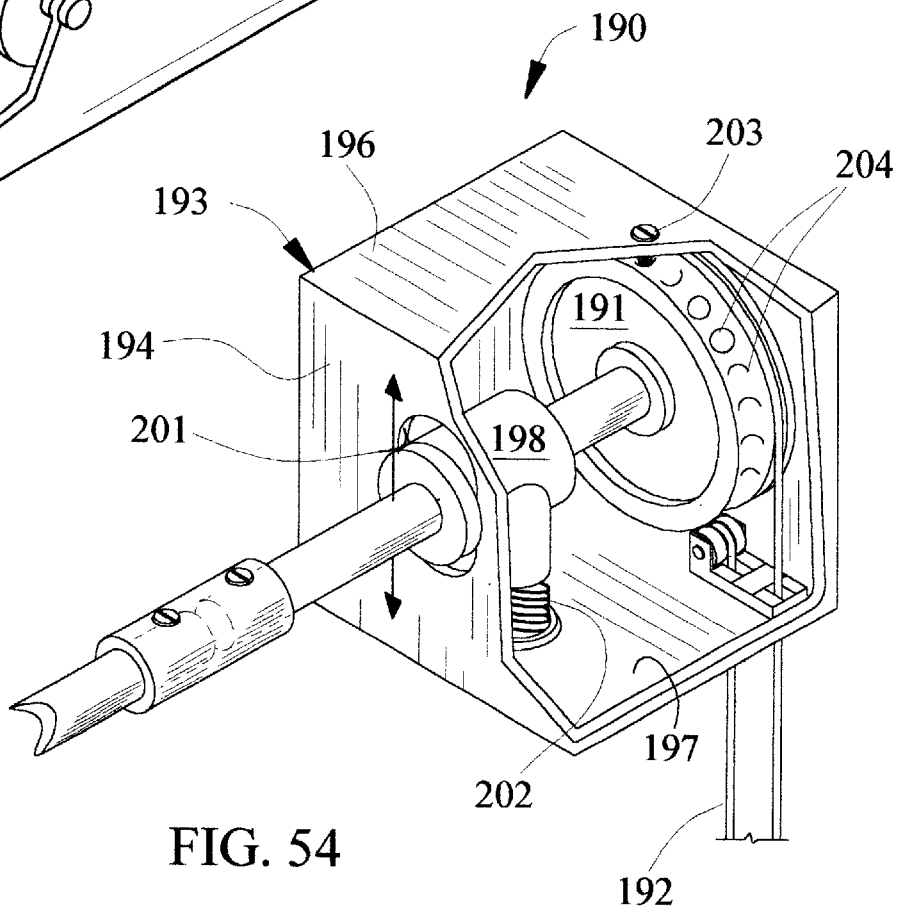
FIG. 54 is a front perspective view, partially cut away, of an automatic cord locking mechanism in accordance with the present invention.

Referring also to FIG. 54, in the illustrated exemplary arrangement, the cord pulley unit 190 includes and is mounted within a housing 193 comprising front wall 194, top wall 196 and bottom wall 197. The pulley 191 is mounted on and rotates together with shaft 50, which extends through a bushing 198 having a circumferential groove 199 that is received by vertically elongated slot 201 in front wall 194, thereby mounting the bushing in the slot and allowing the bushing, shaft 50 and pulley 191 to move up and down.

Figure 55:
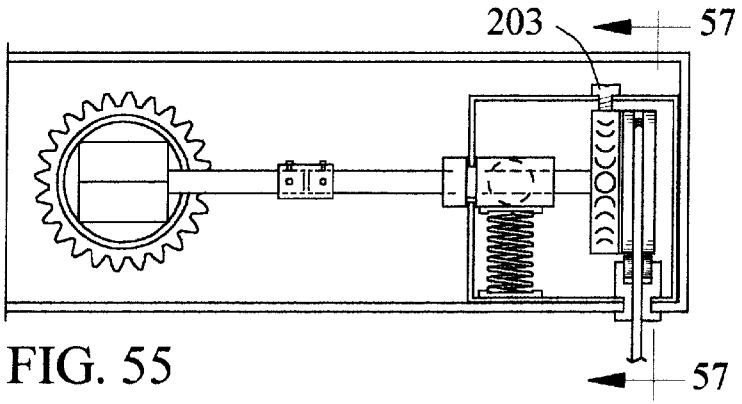
FIGS. 55 and 56 are partial front elevation section views taken along lines 55—55 and 56—56 in FIG. 53 and respectively showing the locking mechanism in the locked position and unlocked position.
Figure 56:
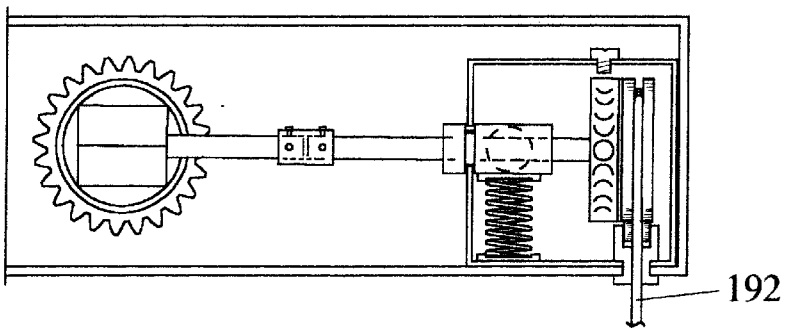

The automatic locking mechanism includes a compression spring 202 which is positioned between the bottom wall 197 and the bushing 198 and biases the bushing 198 against the top of the slot 201. A threaded adjustable screw 203 is mounted through the top wall 196 of the housing and mates with a series of slots 204 in the periphery of the pulley 191. Referring also to FIG. 55, the spring 202 normally biases the pulley 191 against the screw 203, locking the screw in one of the slots 204, preventing rotation of the pulley and pre-venting raising or lowering movement of the cover or blind. In short, the locking mechanism prevents the blind from moving from its selected position. Referring also to FIG. 56, when the front or back section of the cord is pulled downward to raise or lower the blind (alternatively, to lower or raise the blind), the spring 202 is overcome and the pulley 191 is moved downward and out of engagement with the locking screw 203, allowing the pulley to rotate and the blind to move/be moved as desired. When a desired position is reached, the cord 192 is released, allowing the spring 202 to automatically lock the pulley 191 on the screw 203.

Figure 57:
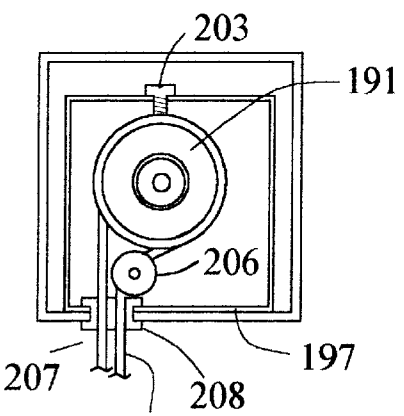
FIG. 57 is an end elevation section view taken along line 57—57 in FIG. 53.

As shown in FIG. 57, the pull cord 192 is routed over the pulley 191 and the section of the cord which extends downward from the rear of the pulley can be routed by a guide pulley 206 to a position adjacent the front section of the cord, and from there both sections are routed by close-spaced bushings 207 and 208 through apertures in the bottom wall 197 of the housing and exit the housing. As alluded to above, when one of the cord sections is pulled, the locking mechanism is released, and the pulley 191 can be rotated to raise or lower the blind. After the blind is positioned as desired, the cord is released, allowing the anti-rotation locking mechanism to automatically re-engage and to maintain the blind in the selected position.

The locking cord system 190 provides access to coverings (and their associated housings) from a distance and thus is useful for coverings which arc difficult or awkward to reach, for example, a covering which is located high on a wall, and a covering access to which is obstructed, for example, by furniture. Also, the use of the various spring drives, transmissions, etc. and combinations thereof contemplated herein result in little effort being required to operate a covering using the cord.

Figure 58:
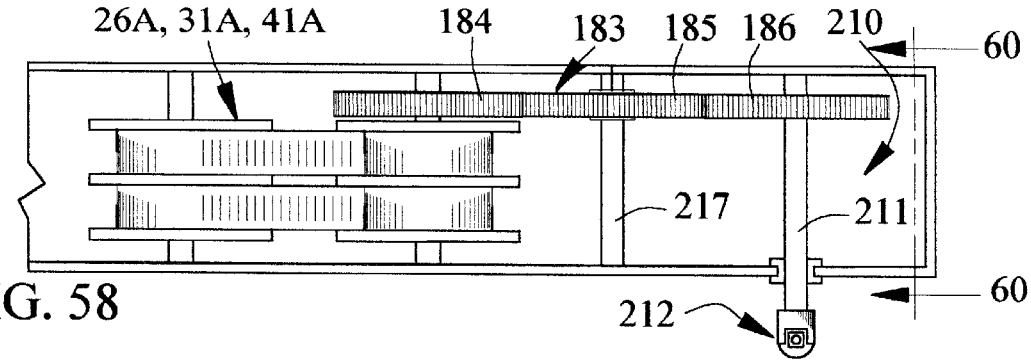
FIG. 58 is a top plan view of a section of a simple, crank-operated, high torque spring drive system in accordance with the present invention.
Figure 59:
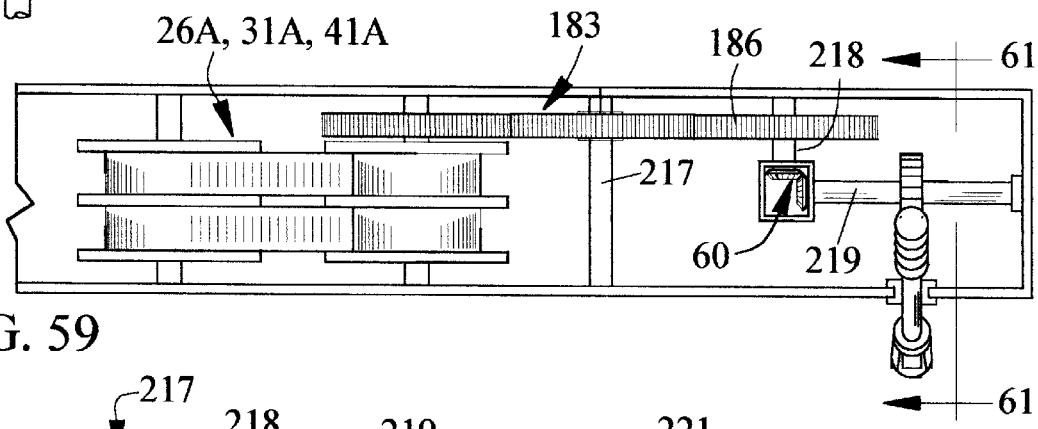
FIG. 59 is a top plan view of a section of an alternative simple, crank-operated, high torque spring drive system in accordance with the present invention.
Figure 62:
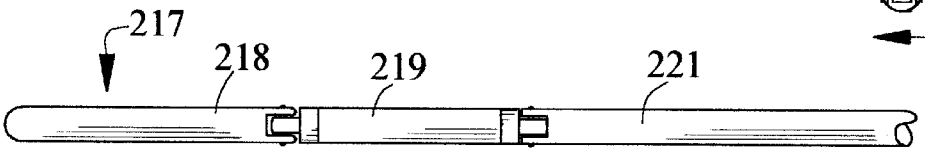
FIGS. 62 and 63 depict a crank which is suitable for use in the systems disclosed in FIGS. 58 and 59.
Figure 63:
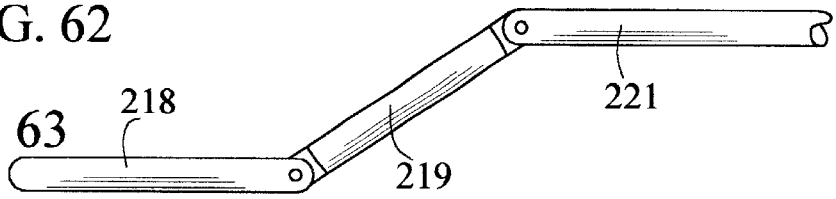

FIGS. 58 and 59 are top plan views of a section of simple high torque spring drive systems according to the present invention. The systems incorporate wand or crank units according to the present invention which operate, that is, raise and lower the associated blind. Each exemplary system includes a varied torque spring drive 31A or 41A or, preferably, a constant torque spring drive 26A, which comprises a pair of spring,s mounted in parallel on integral/joined storage spools and output spools. The spools are mounted on shafts which are oriented transverse to the housing. The plural spring drive system provides increased torque for operating heavy blinds. The spring drive is connected via a direct drive or varied ratio transfer gear train 183 comprising gear wheels or sprockets 184, 185, 186 to crank unit 210, FIG. 58, or crank unit 225, FIG. 59. Crank unit 210 has automatic braking action. whereas embodiment 225 is a free-running crank unit. Both units incorporate a crank such as 217, FIGS. 62 and 63, which comprises hinged sections 218, 219, 221 that permit operating the (crank unit from a position beneath the spring drive housing.

Figure 60:
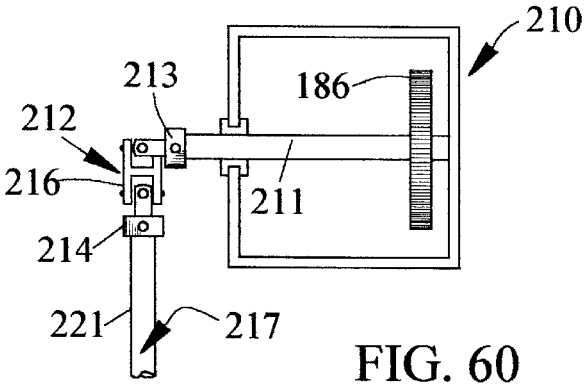
FIG. 60 is an end elevation section view taken along line 60—60 in FIG. 58.

Referring to FIGS. 58 and 60, crank unit 210 comprises transverse, horizontal shaft 211, on one end of which is mounted output sprocket 186 of gear train 183. The shaft 211 extends through a bushing to the front exterior of the spring drive housing. A universal joint 212 pivotally mounts crank 217 to the second end of the shaft 211. The universal joint 212 comprises a connector 213 mounted to the external end of shaft 211, a connector 214 mounted to the upper end of the crank, and an H-shaped connector 216 pivotally mounted to and between the other connectors. Typically, the bent crank, FIG. 63, can be used to raise and lower the blind by rotating the crank end 218 about the axis of upper section 221, so long as the crank upper section 221 is oriented at an acute angle, typically less that 45° to the axis of shaft 211, see A. However, when the crank 217 is released, gravity causes it to assume the nea-vertical orientation shown in FIG. 60, in which orientation rotation of the crank about its longitudinal axis does not rotate the shaft 211 about its longitudinal axis, and vice versa. Rather, rotation of shaft 211 rotates the transverse-oriented crank 217 much like a propeller. As the result of the torque which is required for this rotation, the crank acts as a brake against rotation of the shaft 211 and unwanted movement of the associated blind.

Figure 61:
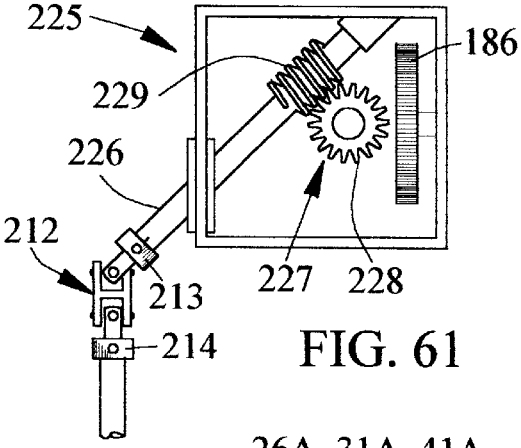
FIG. 61 is an end elevation section view taken along line 61—61 in FIG. 59.

Referring now to FIGS. 59 and 61, crank unit 225 comprises a shaft 226 which is journaled diagonally from the top of the drive housing through a bushing in the front wall. One gear 229 of a worm gear unit 227 is formed on the shaft 226 and the other gear 228 is formed on shaft 219, FIG. 59, which is connected by bevel gear unit 60 to the output sprocket 186. Universal joint 212 pivotally mounts crank 217 to the external end of the shaft 226. The universal joint 212 comprises connector 213 mounted to the external end of shaft 226, connector 214 mounted to the upper end of the crank, and H-shaped connector 216 pivotally mounted to and between the other connectors. As mentioned above, typically, the bent crank, FIG. 63, can be used to raise and lower the blind by rotating the crank end 218 about the longitudinal axis of crank upper section 221, so long as the crank upper section is oriented at an acute angle, typically less that 45°, to the longitudinal axis of shaft 226. Unlike unit 210, at rest shaft 217 hangs at an angle of less than 45° to the angled shaft 226. As a result crank 217 is free-running, that is, without propeller rotation, in the release or rest position: rotation of the crank 217 about its longitudinal axis is translated into rotation of shaft 226 about its longitudinal axis and vice versa. To raise or lower the associated blind, the bent crank is rotated as described above, and the rotation is translated into rotation of shaft 219, the spring drive, and the associated cord pulleys (not shown).

FIG. 59 illustrates an anti-rotation brake in the form of a bracket 234-supported bolt 231 having a pad 233 at its outer end which is biased by spring 232 against axle 219 to provide frictional braking which suppresses unwanted movement when the crank is released, but is easily overcome by rotation of the crank when it is desired to raise or lower the blind.

Similar to the cord system 190, the crank systems 210 and 225 provide access to the covering are especially useful in systems having coverings which are awkward or difficult to reach for extending and retracting, for example, because the covering is located high on a wall, or because access to the covering is obstructed, for example, by furniture. Also, the use of the various spring drives, transmissions, etc. and combinations thereof contemplated herein result in little effort being required to operate the covering using the crank. In addition, the combination of the various spring drives, transmissions, etc. and combinations thereof, in combination with a cord or crank system. provides ease of operation, stability and accessibility. The crank systems may be preferred to the cord system, because the cord typically has to be pulled taut for operation and frequently is anchored at its bottom end to the wall, whereas the crank is inherently rigid and can be pulled away from the wall for operation, thereby more easily circumventing obstacles and more easily providing access from a distance in such circumstances.

l. Battery Assisted Spring Drive System (FIGS. 46–48)

Figure 46:
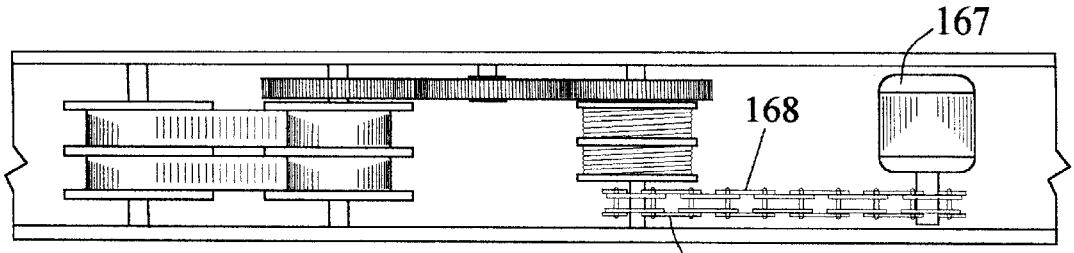
FIGS. 46–48 depict embodiments of electric motor-assisted spring drive systems.
Figure 47:
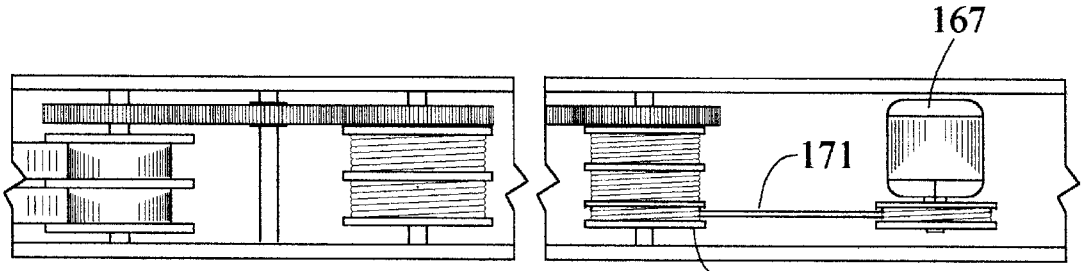
Figure 48:
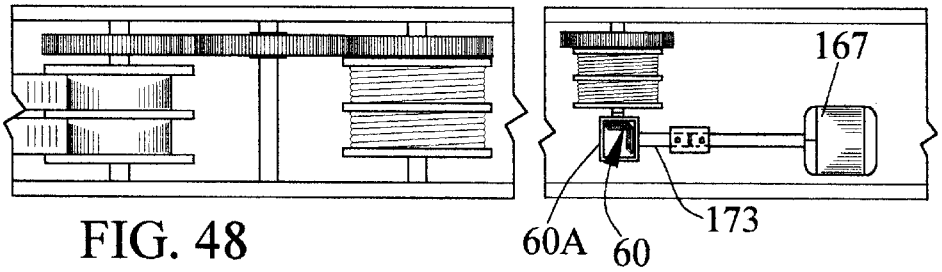

FIGS. 46–48 depict several embodiments of battery-assisted systems in accordance with the present invention. A DC battery-powered electric motor 167 of a type known in the art is connected to the pulley 19 or pulley unit 18 by various drive systems, including a chain drive, FIG. 46, comprising a sprocket 169 and chain 168; a belt drive, FIG. 47, comprising a pulley 172 and cord or belt 171; and a shaft drive, FIG. 48, comprising a shaft 173 connected to the pulley shaft via bevel gear set 60. Aided by the spring drive(s), transmission(s), etc. a small electric motor 167 easily raises and lowers the cover/blind, and can be operated at the blind, for example, by a wall switch, or remotely, by stationary and/or portable controls.

Similar to the single spring drive systems, in one embodiment, at least one of the flat springs is adapted for imparting a torque component to the system torque which varies along the length of that spring. In a specific embodiment, the said spring has a cove or transverse curvature which selectively varies along the length of the spring for providing the torque which varies proportional to the transverse curvature of that spring at a position closely adjacent the output drum. Alternatively, the said spring has at least one hole therein for providing a torque proportional to the transverse size of the hole and the resulting effective width of that spring when the hole is positioned closely adjacent the output drum. In another alternative embodiment, the said spring has holes along its length for providing a torque which varies proportional to the transverse size of the holes and the resulting effective width of the spring when one or more holes is positioned closely adjacent the output drum.

It should be noted that the cover or blind housing which mounts the blind and the spring drive can be mounted along the bottom of the window or other surface to be covered, so that the blind extends upward for closing and retracts downward for opening. For convenience, in this document we describe the operation of top mounted, downward opening blinds and spring drives. However, it is understood that the invention is applicable to upwardly closing blinds, which typically have a bottom-mounted spring drive unit mount. The versatility of the spring drive system according to the present invention in adapting the spring torque characteristics to the operational characteristics of a given cover or blind as well as the braking action of the, make the system applicable to blinds of any operating orientation (top, bottom, lateral, etc.), weight and length.

The present invention has been described in terms of a preferred and other embodiments. The invention, however, is not limited to the embodiments described and depicted. One familiar with the art to which the present invention pertains will appreciate from the various carriers and blind/cover arrangements disclosed here, that the present invention is applicable in general to articles, objects or systems designed for support by and traversal along tracks. Adaptation of the system to other articles, objects and systems, including other blinds will be readily done by those of usual skill in the art. The invention is define,d by the claims appended hereto.

What is claimed is:

1. A spring drive system comprising: a first storage drum; a second rotatable drum; and a substantially flat, coved spring wound on the two drums and having a cove of selected curvature which varies along the length of the spring for providing a force which varies proportional to the curvature of the cove as the spring winds and unwinds.

2. The spring drive system of claim 1, further comprising a magnetic brake comprising magnetized regions at selected positions along the substantially flat spring; and a magnet brake member mounted adjacent the substantially flat spring, the magnetism of the magnetized regions and the brake member selected for stopping the substantially flat spring at the selected positions.

3. The spring drive of claim 1, further comprising a detent brake comprising holes at selected positions along the substantially flat spring; and a detent brake member biased against the substantially flat spring for engaging the holes and stopping the substantially flat spring at the selected positions.

4. A spring drive system comprising: a first storage drum; a second rotatable drum; and a substantially flat spring wound on the two drums and having a cove of selected curvature which varies along the length of the spring for providing a force which varies proportional to the curvature of the cove as the spring winds and unwinds, the transverse section of the spring having opposite edge sections and an intermediate section and at least a longitudinal section of the spring having a curvature of the opposite edge sections which is opposite the curvature of the intermediate section, for reducing the torque provided along said longitudinal section of the spring.

5. The spring drive system of claim 4, wherein the relative curvature of the edge sections and the intermediate section varies along said longitudinal section of the spring.

6. A spring drive system comprising: a first storage drum; a second rotatable drum; and a substantially flat spring wound on the two drums and having holes of selected size and location along the spring for providing a force which varies proportional to the size and location of the spring as the spring winds and unwinds at the second drum.

7. A spring drive system comprising: an output drum; a plurality of storage drums, each having a substantially flat spring wound thereon; wherein at least one of the substantially flat springs has a cove which selectively varies along the length of the spring for providing a torque which varies proportional to the cove of the said one spring at a position adjacent the output drum; and the plurality of springs extending to and wound together in overlapping fashion on the output drum, whereby the system torque at the output drum is a multiple of the torques associated with the individual springs.

8. The spring drive system of claim 7, wherein the storage drums are arranged in approximately a straight line.

9. The spring drive system of claim 7, wherein the output drum and the storage drums are arranged in approximately a straight line.

10. The spring drive system of claim 7, wherein the storage drums are arranged in a cluster.

11. The spring drive system of claim 7, wherein the output drum and the storage drums are arranged in a cluster.

12. The spring drive system of claim 7, wherein at least one of the substantially flat springs is adapted for imparting a torque component to the system torque which varies along the length of the said one spring.

13. The spring drive system of claim 7, wherein at least one of the substantially flat springs has a cove or transverse curvature which selectively varies along the length of the spring for providing a torque which varies proportional to the transverse curvature of the said one spring at a position closely adjacent the output drum.

14. The spring drive system of claim 7, wherein at least one of the substantially flat springs has a cove or transverse curvature which selectively varies along the length of the spring for providing a torque which varies proportional to the transverse curvature as the spring winds and unwinds, the transverse curvature of the spring having opposite edge sections and an intermediate section and at least a longitudinal section of the spring having a curvature of the edge sections which is opposite the curvature of the intermediate sections, for reducing the torque provided along the longitudinal section of the spring.

15. The spring drive system of claim 7, wherein at least one of the substantially flat springs has at least one hole therein for providing a torque proportional to the transverse size of the hole and the resulting effective width of the said one substantially flat spring when the hole is positioned closely adjacent the output drum.

16. The spring drive system of claim 7, wherein at least one of the substantially flat springs has holes along the substantially flat spring for providing a torque which varies proportional to the transverse size of the holes and the resulting effective width of the said one substantially flat spring when one or more holes is positioned closely adjacent the output drum.

17. A window cover system comprising:

an extendible window cover; a housing; lift cords attached to the cover and wrapped around pulleys mounted to the housing for raising and lowering the extendible cover; and a spring drive system connected to the lift cords for assisting the raising and lowering of the cover; the spring drive system comprising:

a shaft mounted to the housing, a spring drive comprising at least one substantially flat spring; the spring drive being mounted to the housing and having a storage end and a rotatable end, the spring drive having a torque or force which decreases as the cover is extended and increases as the cover is retracted, and a bevel gear set having one gear connected to the rotatable spring end and a second gear operatively connected to the shaft for rotating the lift cord pulleys, the spring drive thereby applying the varying torque or force to the cover and having inherent inertia maintaining the position of the cover.

18. The window cover system of claim 17, further comprising: a gear transmission of fixed drive ratio and inherent rotating friction; the second gear connecting one end of the gear transmission to the rotatable end of the spring drive; and the end of the gear transmission opposite the first end thereof being connected to the shaft for rotating the lift cord pulleys, the gear transmission thereby applying the fixed ratio between the spring drive and the lift cords, determining the ratio of the cover travel distance to the winding distance of the substantially flat spring and controlling the force applied to the cover by the spring drive, and applying the inherent friction thereof to the lift cord pulleys for maintaining the position of the cover.

19. A window cover system comprising:

an extendible window cover; a housing; lift cords attached to the cover and wrapped around pulleys mounted to the housing for raising and lowering the extendible cover; and a spring drive system connected to the lift cords for assisting the raising and lowering of the cover, the spring drive system comprising three transverse shafts mounted to the housing; a substantially flat spring mounted to two of the transverse shafts and having a storage end and a rotatable end, the substantially flat spring having a torque or force which decreases as the cover is extended and increases as the cover is retracted; a pulley set rotatably mounted on the third shaft; and a gear set connecting the substantially flat spring to the pulley set and comprising a first gear mounted on the second shaft connected to the rotatable end of the substantially flat spring and a second gear mounted on the third shaft and connected to the lift cord pulleys, the substantially flat sprint, thereby applying the varying torque or force to the extendible cover and having inherent inertia maintaining the position of the cover, and the gear set applying holding friction to the lift cord pulleys for maintaining the position of the cover.

20. A window cover system comprising:

an extendible window cover; a housing; and a spring drive system connected to the lift cords for assisting the raising and lowering of the cover, the spring drive system comprising four transverse shafts mounted to the housing and comprising in order first, second, third and fourth shafts; a flat spring drive having a storage end mounted to the first shaft and a rotatable end mounted to the second shaft, the flat spring drive having a torque or force which decreases as the cover is extended and increases as the cover is retracted; a pulley set rotatably mounted on the fourth shaft; lift cords attached to the cover and wrapped around the pulley set for raising and lowering the extendible cover; and a gear set of three intermeshed gears connecting the spring drive to the pulley set and comprising a first gear mounted on the second shaft connected to the rotatable spring end, a second gear mounted on the third shaft and a third gear mounted on the fourth shaft connected to the lift cord pulleys, the spring drive thereby applying the varying torque or force to the extendible cover and having inherent inertia maintaining the position of the cover, and the gear set applying holding friction to the lift cord pulleys for maintaining the position of the cover.

21. A window cover system comprising:

an extendible window cover; a housing; and a spring drive system connected to the lift cords for assisting the raising and lowering of the cover, the spring drive system comprising four transverse shafts mounted to the housing and comprising in order first, second, third and fourth shafts; a pulley set rotatably mounted on the fourth shaft; lift cords attached to the cover and wrapped around the pulley set for raising and lowering the extendible cover; a band transmission comprising a band wrapped around two drums, a first of the drums mounted on the third shaft and the second drum mounted on the fourth shaft connected to the lift cord pulleys for rotating the fourth shaft at a rate that varies relative to the rate of the third shaft; a gear set of two intermeshed gears connecting the second shalt to the third shaft and comprising a first gear mounted on the second shaft and a second gear mounted on the third shaft and connected to the first drum of the band transmission; and a flat spring drive having a storage end mounted to the first shaft and a rotatable end mounted to the second shaft and connected to the first gear, the flat spring drive having a torque or force which decreases as the cover is extended and increases as the cover is retracted, the spring drive thereby applying the varying torque or force to the extendible cover and having inherent inertia maintaining the position of the cover; the gear set having a selected fixed ratio for contributing to the overall spring drive-to-pulley gear ratio, and the gear set applying holding friction to the lift cord pulleys for maintaining the position of the cover; and the band transmission having a ratio which varies as the drums wind and unwind for varying the overall spring drive-to-pulley gear ratio.

22. A window cover system comprising:

an extendible window cover; a housing; and a spring drive system connected to the lift cords for assisting the raising and lowering of the cover, the spring drive system comprising three transverse shafts mounted to the housing; a flat spring drive mounted to two of the transverse shafts and having a storage end and a rotatable end, the flat spring drive having a torque or force which decreases as the cover is extended and increases as the cover is retracted; a pulley set rotatably mounted on the third shaft; lift cords attached to the cover and wrapped around the pulley set for raising and lowering the extendible cover; a gear set comprising a first gear mounted on the second shaft connected to the rotatable spring output end and a second gear mounted over and rotatable around the third shaft; and a gear transmission of fixed drive ratio, the gear transmission mounted at one end to the second gear and on and rotatable about the third shaft, and mounted at the second end on and to the third shaft for rotation with the pulleys; the spring drive having inherent inertia maintaining the position of the cover at selected positions; the gear set having a fixed ratio which fixedly alters the overall drive ratio between the spring drive and the pulleys; and the gear transmission having a storage which fixedly alters the overall drive ratio between the band transmission and the chain drive, thereby fixedly altering the overall drive ratio between the spring drive and the pulleys, and applying holding friction to the pulleys for maintaining the position of the cover.

23. A window cover system comprising:

an extendible window cover; a housing; and a spring drive system connected to the lift cords for assisting the raising and lowering of the cover, the spring drive system comprising four transverse shafts mounted to the housing and comprising in order first, second, third and fourth shafts; a plurality of pulleys rotatably mounted by the fourth shaft; lift cords attached to the cover and wrapped around the pulleys for raising and lowering the extendible cover; a chain drive mounted at one end on the third shaft for rotation therewith and mounted at the second end on the fourth shaft and connected to the pulleys for rotation therewith; a flat spring drive having a storage end mounted to the first shaft and a rotatable output end mounted to the second shaft, the flat spring drive having a torque or force which decreases as the cover is extended and increases as the cover is retracted; a band transmission comprising a flat band wrapped around two drums, a first of the drums mounted on the second shaft connected to the rotating output end of the spring drive and the second drum mounted for rotation around the third shaft; a gear transmission of fixed drive ratio, the transmission mounted at one end to the band transmission for rotation therewith around the third shaft and mounted at the second end on the third shaft for rotation with the chain drive; the spring drive having inherent inertia maintaining the position of the cover at selected positions; the band transmission having a ratio which varies as the drums wind and unwind, thereby rotating the first end of the gear transmission at a rate that varies relative to the rate of the second shaft and varying the overall spring drive-to-pulley gear ratio; and the gear transmission applying the fixed ratio between the band transmission and the chain drive, thereby fixedly altering the overall drive ratio between the spring drive and the pulleys, and applying holding friction to the pulleys for maintaining the position of the cover.

24. A window cover system comprising: an extendible window cover; a housing; at least one lift cord attached to the cover and wrapped around a pulley mounted to the housing for extending and retracting the extendible cover; a plurality of spring drives, connected to the pulley for assisting the extending and retracting of the cover; the individual ones of the spring drives comprising a first, storage spool, a second, output spool operatively connected to the pulley, and a flat spring wound on and between the first and second spools; and a crank operatively connected to the pulley for rotating the pulley to extend and retract the associated cover.

25. A window cover system comprising: an extendible window cover; a housing; at least one lift cord attached to the cover and wrapped around a pulley mounted to the housing for extending and retracting the extendible cover; a plurality of spring drives, connected to the pulley for assisting the extending and retracting of the cover; the individual ones of the spring drives comprising a first, storage spool, a second, output spool operatively connected to the pulley, and a flat spring wound on and between the first and second spools; a rotatable wheel mounted to the housing; a pull cord routed over the housing and depending from the housing; means connecting the wheel to the output spool whereby pulling on the cord extends and retracts the cover; and releasable lock means for locking the wheel against movement when the cord is not pulled and releasing from the wheel when the cord is pulled.

26. A window cover system comprising: an extendible window cover; a housing; at least one lift cord attached to the cover and wrapped around a pulley mounted to the housing for extending and retracting the extendible cover; a plurality of spring drives, connected to the pulley for assisting the extending and retracting of the cover; the individual ones of the spring drives comprising a first, storage spool, a second, output spool operatively connected to the pulley, and a flat spring wound on and between the first and second spools; and a first shaft on which the output spool is mounted and a second shaft on which the pulley is mounted, the two shafts being oriented transverse to one another; and a pair of meshed bevel gears mounted one on each shaft and connecting the shafts for rotation together.

27. A window cover system comprising: an extendible window cover; a housing at least one lift cord attached to the cover and wrapped around a pulley mounted to the housing for extending and retracting the extendible cover; a plurality of spring drives, connected to the pulley for assisting the extending and retracting of the cover; the individual ones of the spring drives comprising a first, storage spool, a second, output spool operatively connected to the pulley, and a flat spring wound on and between the first and second spools; a cord pulley system comprising a pair of reverse oriented, conical spools rotatably mounted on shafts and having spiral grooves winding longitudinally thereon; a cord wound on the grooves of and between the spools; and one cone-mounting shaft being operatively connected to the output spool for rotating with the output spool and the other cone-mounting shaft being operatively connected to the pulley for rotating with the pulley; whereby the relative angular rotation speed of the output pool and the pulley during winding and unwinding of the lift cord is determined by the associated position of the cord on the conical spools and the diameters of the conical spools at that position.

28. The window cover system of claim 27, wherein the cord pulley system is direct drive.

29. The window cover system of claim 27, wherein the cord pulley system is varied ratio.

30. A window cover system comprising: an extendible window cover; a housing; at least one lift cord attached to the cover and wrapped around a pulley mounted to the housing for extending and retracting the extendible cover; a plurality of spring drives, connected to the pulley for assisting the extending and retracting of the cover; the individual ones of the spring drives comprising a first, storage spool, a second, output spool operatively connected to the pulley, and a flat spring wound on and between the first and second spools; a rotatable recoiled roll comprising: a shaft; a hub mounted on the shaft; and a plurality of resilient fins extending generally radially from the hub; the recoiled roll being positioned adjacent and contacting a spool or spring of the spring drive, to suppress uncontrolled expansion of the wound spring and brake the spring drive.

31. A window cover system comprising:

a window cover; a housing; a pulley shaft rotatably mounted to the housing; a plurality of pulleys mounted on the pulley shaft for rotation therewith; a plurality of lift cords attached to the window cover and wrapped around the pulleys for raising and lowering the window cover when the pulleys rotate; and a spring drive system operatively connected to the lift cords for assisting the raising and lowering of the cover, the spring drive system comprising:

a spring drive mounted to the housing, the spring drive comprising a rotatable shaft, and a coiled flat spring comprising a storage end and an output end mounted to the rotatable shaft for rotation therewith, the spring drive having inherent inertia opposing movement of the cover from rest; and a transmission comprising first and second rotatable shafts; the first transmission shaft operatively connected to tile output end shaft of the spring drive; the second transmission shaft operatively connected to the pulley shaft; and the transmission applying a selected gear ratio between the two transmission shafts such that the second transmission shaft rotates at a selected rate relative to the rate of rotation of the first transmission shaft and the spring output end shaft, thereby providing a selected gear ratio which decreases the torque or force of the spring drive applied to the second transmission shaft as the spring is unwound and increases the torque or force of the spring drive applied to the second transmission shaft as the spring is rewound.

32. The window cover system of claim 31, wherein the selected gear ratio is a varying ratio and transmission is a variable ratio coral transmission, and further comprises a cord wrapped around the two transmission shafts, the cord and the diameters of the two transmission shafts being selected to vary the rotation rate the second transmission shaft relative to the rotation rate of the first transmission shaft which decreases the torque or force of the spring drive applied to the second transmission shaft as rile spring is unwound and increases the torque or force of the spring drive applied to the second transmission shaft as the spring is retracted.

33. The window cover system of claim 32, further comprising:

a gear set comprising at least two intermeshed gears interposed between and interconnecting the second transmission shaft and the pulley shaft and including a first gear operatively connected to the second transmission shaft and a second gear operatively connected to the pulley shaft; the gear set applying the varying gear ratio of the variable rate transmission to the pulley shaft and having a selected fixed ratio contributing to the overall spring drive-to-pulley gear ratio.

34. The window cover system of claim 33, further comprising a spring-biased brake device comprising a brake element positioned adjacent the spring drive and a spring selectively biasing the brake element against the spring drive for selectively braking the spring drive.

35. The window cover system of claim 31, wherein the transmission is a fixed ratio gear transmission, and further comprises a plurality of intermeshed gears interconnecting the two transmission shafts, and providing a fixed gear ratio between the two transmission shafts for rotating the second transmission shaft at a fixed rate relative to the first transmission shaft.

36. The window cover system of claim 35, further comprising a bevel gear set comprising first and second intermeshed bevel gears; the first bevel gear being operatively connected to the second gear of the fixed ratio gear transmission for rotation therewith and the second bevel gear being operatively connected to the pulley shaft for rotation therewith; the bevel gear set thereby transferring rotation of the fixed ratio gear set to the pulley shaft and vice versa.

37. A window cover system comprising:

a window cover; a housing; a pulley shaft rotatably mounted to the housing; a plurality of pulleys mounted on the pulley shaft for rotation therewith; a plurality of lift cords attached to the window cover and wrapped around said pulleys for raising and lowering the window cover when the pulleys rotate; and a spring drive system operatively connected to the lift cords for assisting the raising and lowering of the cover, the spring drive system comprising:

a variable ratio cord transmission comprising first and second rotatable transmission shafts and a band or cord wrapped around the first and second transmission shafts for rotating the second transmission shaft at a rate that varies relative to the rate of the first transmission shaft;

a gear set comprising at least two intermeshed gears interposed between and interconnecting the second transmission shaft and the pulley shaft and including a first gear operatively connected to the second transmission shaft and a second gear operatively connected to the pulley shaft;

a spring drive mounted to the housing, the spring drive comprising a storage end and an output end which rotatably winds and unwinds, the output end being operatively connected to the first transmission shaft for rotating the first transmission shaft therewith as the output end winds and unwinds; and the gear set having a selected fixed ratio contributing to the overall spring drive-to-pulley gear ratio, and the gear set applying holding friction to the lift cord pulleys opposing movement of the cover from rest.

38. A window cover system comprising:

a window cover; a housing; a pulley shaft mounted within the housing for rotation; a pulley mounted on the pulley shaft for rotation therewith; a lift cord attached to the window cover and wrapped around the pulley for operating the window cover by retracting and extending the window cover when the pulley rotates; and a spring drive system operatively connected to the lift cord for assisting the operation of the window cover, the spring drive system comprising:

a spring drive mounted to the housing, the spring drive comprising a coiled flat spring having a storage end and a rotatable output end for winding and unwinding, the spring drive having inherent inertia opposing movement of the cover from rest; and a transmission comprising first and second rotatable shafts; the first transmission shaft operatively connected to the output end of the spring drive; the second transmission shaft operatively connected to the pulley; and the transmission applying a selected gear ratio between the two transmission shafts such that the second transmission shaft rotates at a selected rate relative to the rate of rotation of the first transmission shaft and the spring output end, thereby providing a selected gear ratio which alters the torque or force of the spring drive applied to the second transmission shaft as the spring winds and unwinds.

39. The window cover system of claim 38, wherein the selected gear ratio is a varying ratio and the transmission further comprises a cord wrapped around the two transmission shafts, the cord and the diameters of the two transmission shafts being selected to vary the rotation rate of the second transmission shaft relative to the rotation rate of the first transmission shaft which decreases or increases the torque or force of the spring drive applied to the second transmission shaft as the spring is unwound and increases or decreases the torque or force of the spring drive applied to the second transmission shaft as the spring is retracted.

40. The window cover system of claim 39, further comprising a spring-biased brake device including a brake member positioned adjacent the spring drive and a spring selectively biasing the brake member against the spring drive for selectively braking the spring drive.

41. The window cover system of claim 39 further comprising a brake device including a magnetic brake member positioned adjacent the spring drive and means biasing the brake member against the spring drive for selectively braking the spring drive.

42. The window cover system of claim 38, wherein the selected gear ratio is fixed and the transmission further comprises a plurality of intermeshed gears interconnecting the two transmission shafts, and providing a fixed gear ratio between the two transmission shafts for rotating the second transmission shaft at a fixed rate relative to the first transmission shaft.

43. The window cover system of claim 42, further comprising a spring-biased brake device including a brake member positioned adjacent the spring drive and a spring selectively biasing the brake member against the spring drive for selectively braking the spring drive.

44. The window cover system of claim 42, further comprising a brake device including a magnetic brake member positioned adjacent the spring drive and means biasing the brake member against the spring drive for selectively braking the spring drive.

* * * * *